US006520870B2

(12) United States Patent
Tzivanis et al.

(10) Patent No.: US 6,520,870 B2
(45) **Date of Patent: *Feb. 18, 2003**

(54) GOLF BALL

(75) Inventors: Michael J. Tzivanis, Chicopee, MA (US); Mark L. Binette, Ludlow, MA (US); Thomas J. Kennedy, III, Wilbraham, MA (US); John L. Nealon, Springfield, MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/904,617

(22) Filed: Jul. 13, 2001

(65) Prior Publication Data

US 2002/0065149 A1 May 30, 2002

Related U.S. Application Data

(60) Provisional application No. 60/217,900, filed on Jul. 13, 2000, and provisional application No. 60/218,572, filed on Jul. 13, 2000.

(51) Int. Cl.[7] ..... A63B 37/00; A63B 37/04; A63B 37/06

(52) U.S. Cl. ..... 473/371; 473/373; 473/374; 473/376; 473/377; 473/351

(58) Field of Search ..... 473/371, 373, 473/351, 376, 374, 356, 364, 368, 370, 361

(56) References Cited

U.S. PATENT DOCUMENTS

| | | | | |
|---|---|---|---|---|
| 4,431,193 A | | 2/1984 | Nesbitt | |
| 4,683,257 A | | 7/1987 | Kakiuchi et al. | |
| 4,984,804 A | | 1/1991 | Yamada et al. | |
| 5,857,925 A | * | 1/1999 | Sullivan et al. | 473/373 |
| 6,126,559 A | * | 10/2000 | Sullivan et al. | 473/377 |
| 6,142,886 A | * | 11/2000 | Sullivan et al. | 273/DIG. 20 |
| 6,152,835 A | * | 11/2000 | Sullivan et al. | 473/373 |
| 6,245,858 B1 | * | 6/2001 | Sullivan et al. | 473/372 |
| 6,271,316 B1 | * | 8/2001 | Sullivan et al. | 473/377 |
| 6,350,793 B1 | * | 2/2002 | Kennedy et al. | 473/371 |
| 6,368,236 B1 | * | 4/2002 | Sullivan et al. | 473/371 |
| 6,394,913 B1 | * | 5/2002 | Nesbitt et al. | 473/351 |

* cited by examiner

*Primary Examiner*—Paul T. Sewell
*Assistant Examiner*—Tom Duong

(57) ABSTRACT

The present invention is directed to a golf ball comprising a soft, high resilience, solid core, comprising, in part, a combination of high molecular weight polybutadiene rubbers, and a soft outer cover disposed about the core. The core preferably is relatively large and durable, and the cover is preferably thin and includes a specific combination of hard and/or soft, yet durable, resinous materials. Preferably, the ball is a two-piece golf ball.

20 Claims, 2 Drawing Sheets

GOLF BALL

CROSS REFERENCE TO RELATED APPLICATIONS

This application claims the benefit of the filing date of U.S. Provisional Application Nos. 60/217,900 and 60/218,572, both filed on Jul. 13, 2000.

FIELD OF THE INVENTION

The present invention relates generally to golf balls exhibiting high potential spin rate characteristics. More particularly, the invention relates to high spinning golf balls having a relatively soft, high resilience, solid polybutadiene core and a soft outer cover. Preferably, the balls are of two-piece construction comprising a large core and a thin cover.

BACKGROUND OF THE INVENTION

Until relatively recently, many highly skilled, low handicap golfers had utilized wound golf balls for competitive play. These balls have a wound core (i.e., a liquid or solid center and elastic windings) and a balata or balata-like cover.

Balata covered wound golf balls are known for their soft feel and high spin rate potential. However, balata covered balls suffer from the drawback of low durability. Among other things, even in normal use, the balata covering can become cut and scuffed, making the ball unsuitable for further play. Additionally, the internal elastic windings are susceptible to breakage upon ball striking, and/or the center of the ball can be knocked off center or "out of round". Furthermore, the coefficient of restitution of wound balls is reduced at low temperatures.

The problems associated with balata covered balls have resulted in the widespread use of durable ionomeric resins as golf ball covers. However, balls made with ionomer resin covers typically have higher PGA® compression ratings. Those familiar with golf ball technology and manufacture will recognize that golf balls with higher PGA® compression ratings are considered to be harder than conventional balata covered balls.

Consequently, it would be useful to develop a golf ball having a durable, yet comparatively soft, cover which has the sound and feel of a balata covered wound ball. It would also be useful to develop a solid core golf ball having the overall desired spin and flight characteristics exhibited by balata covered wound balls.

Taken as a whole, the solid core balls of the present invention exhibit the high spin (mid-iron through wedge), flight characteristics (i.e., launch angle, trajectory, etc.) and feel produced by balata covered wound golf balls. The balls of the invention also exhibit enhanced durability with equal or superior distance.

The present invention is accomplished, in part, by combining a soft, durable cover with a relatively soft, solid core. The core is constructed using high molecular weight polybutadiene or other rubbers exhibiting enhanced coefficient of restitution (C.O.R.). The golf balls of the invention have a core compression and an overall ball PGA® compression of 90 or less, preferably less than 80, and most preferably less than 75. The hardness of the cover is soft enough so that the PGA® compression of the overall ball is substantially the same or lower than that of the core.

Moreover, the properties of the core and/or cover of the balls of the invention can be adjusted to obtain the particular spin rates desired. For example, larger or heavier cores can be utilized for even greater spin rates, (although lower C.O.R. may result), softer covers can be utilized for higher spin rates, etc. Preferably, the golf balls of the present invention utilize relatively large, soft cores and thin, soft covers. The cores and/or balls of the invention can be optionally irradiated to additionally improve such properties as C.O.R., scuff, and melt resistance.

In addition, the particular dimple pattern of the balls can be selected to further optimize the desired spin rates. Similarly, the flight/trajectory of the ball can be adjusted depending upon the dimple pattern selected and the core and cover materials utilized in construction.

Prior to the present invention, high spin, two-piece golf balls consisted generally of hard cores having covers varying in hardness/softness. The hard cores were necessary to achieve the desired resiliency, i.e., C.O.R., needed for enhanced distance, etc. Additionally, hard cores were utilized to produce higher spin rates. This is because at impact, the hard core compresses the cover of the ball against the clubface to a much greater degree than a soft core. This compression results in more "grab" of the ball on the clubface and subsequent higher spin rate. In effect the cover is squeezed between the relatively incompressible core and clubhead. When a softer core is used, the cover is under much less compressive stress than when a harder core is used and therefore does not contact the clubface as intimately. This results in lower spin rates.

However, while the hard core, two-piece balls exhibited enhanced spin rates, this was essentially for all clubs. Additionally, the hard core, two-piece balls produced generally a poor, or hard, responsive feel to the golfer.

The resulting balls of the present invention utilize a soft, high resilience core and a relatively thin, soft cover. Preferably, the balls of the invention comprise two-piece golf balls. The balls produce high spin rates, equal to or greater than balata covered wound golf balls with the same or better distance. The balls also produce improved feel over traditional two-piece golf balls.

Additionally, machine and limited player testing also indicates that the flight/trajectory of the balls of the invention approaches the "rising" trajectory exhibited by the balata covered wound golf balls. The "rising", as opposed to a "boring" or "penetrating" trajectory, is preferred by players who find it difficult to attack tight pin positions or be those who find it difficult to keep the ball in narrow fairways off the tee.

With respect to several of the enhanced properties of the invention, two of the principal properties involved in the performance of golf balls are resilience and hardness. Resilience is determined by the coefficient of restitution (referred to as "C.O.R."), also expressed as the constant "e", which is the ratio of the relative velocity of two elastic spheres after direct impact to that before impact, or more generally, the ratio of the outgoing velocity to incoming velocity of a rebounding ball. As a result, the coefficient of restitution (i.e. "e") can vary from zero to one, with one being equivalent to an elastic collision and zero being equivalent to an inelastic collision.

Hardness/softness of a ball is determined as the deformation (i.e. compression) of the ball under various load conditions applied across the ball's diameter. The lower the deformation, the harder the material.

Resilience (C.O.R.), along with additional factors such as clubhead speed, angle of trajectory, and ball configuration (i.e. dimple pattern), generally determine the distance a ball will travel when hit. Since clubhead speed and the angle of trajectory are not factors easily controllable, particularly by golf ball manufacturers, the factors usually of concern among manufacturers are the coefficient of restitution (C.O.R.) and the surface configuration of the ball.

In this regard, the coefficient of restitution of a golf ball is generally measured by propelling a ball at a given speed against a hard surface and electronically measuring the ball's incoming and outgoing velocity. The coefficient of restitution is believed to be carefully controlled in all commercial golf balls in order for the ball to be within the specifications regulated by the United States Golfers Association ("U.S.G.A.").

Along this line, the U.S.G.A. standards indicate that a "regulation" ball cannot have an initial velocity (i.e. the speed off the club) exceeding 255 feet per second (250 feet per second with a 2% tolerance). Since the coefficient of restitution of a ball is related to the ball's initial velocity (i.e. as the C.O.R. of a ball is increased, the ball's initial velocity will also increase), it is highly desirable to produce a ball having a sufficiently high coefficient of restitution to closely approach the U.S.G.A. limit on initial velocity, while having an ample degree of hardness (i.e. impact resistance) to produce enhanced durability.

The coefficient of restitution (C.O.R.) in solid core balls is a function of the composition of the molded core, the intermediate layers (if any) and of the cover. In balls containing a wound core (i.e. balls comprising a liquid or solid center, elastic windings, and a cover), the coefficient of restitution is a function of not only the composition of the center and cover, but also the composition and tension of the elastomeric windings.

Polybutadiene rubber has been utilized for years in forming molded golf ball cores. Prior artisans have investigated utilizing various grades of polybutadiene in core compositions. For example, such attempts are described in U.S. Pat. Nos. 5,385,440; 4,931,376; 4,683,257; 4,929,678; 4,955,613; 4,974,852; 4,984,803; 5,082,285; and 5,585,440; and in Japanese Patent References JP 58225138 and JP 7268132, all of which are hereby incorporated by reference. Although some of the core compositions described in these disclosures are somewhat satisfactory, a need remains for an improved composition for forming golf ball cores.

Accordingly, it is an object of the present invention to provide an improved polybutadiene composition which, when utilized to formulate golf ball cores, produces golf balls exhibiting enhanced C.O.R. without increasing hardness. An additional object of the invention is to produce a durable, soft golf ball core from a polybutadiene composition having a high Mooney viscosity and/or a high molecular weight and low dispersity.

Additionally, it is another object of the present invention to provide an improved core composition which, when utilized to formulate golf ball cores, produces golf balls exhibiting enhanced C.O.R., relatively soft compression and improved processing.

A further object of the invention is to combine the improved core composition with a durable, yet relatively soft, cover material. Various cover compositions have been developed in order to optimize, along with the core compositions, the desired properties (spin, feel, distance, durability, etc.) of the resulting golf balls. Preferably, the cover is relatively thin and comprises of a blend of hard and/or soft resinous materials to further enhance the spin rate and feel of the balls.

In this regard, the spin rate and feel of a golf ball are particularly important aspects to consider when selecting a golf ball for play. A golf ball with the capacity to obtain a high rate of spin allows a skilled golfer the opportunity to maximize control over the ball. This is particularly beneficial when hitting a shot on an approach to the green.

Golfers have traditionally judged the softness of a ball by the sound of the ball as it is hit with a club. Soft golf balls tend to have a low frequency sound when struck with a club. This sound is associated with a soft feel and thus is desirable to a skilled golfer. Consequently, another object of the invention is to provide a golf ball having an enhanced feel and a pleasing sound on impact with a golf club.

These and other objects and features of the invention will be apparent from the following summary and description of the invention and from the claims.

BRIEF SUMMARY OF THE INVENTION

The present invention achieves all of the foregoing objectives and provides, in a first aspect, a golf ball comprising a soft, high resilience, solid core, comprising, in part, a combination of high molecular weight polybutadiene rubbers, and a soft outer cover disposed about the core. The core preferably is relatively large and durable, and the cover preferably includes a specific combination of hard and/or soft, yet durable, resinous materials. Preferably, the ball is a two-piece ball.

The core and the overall compression of the balls of the present invention are relatively soft. The core has a PGA® compression of 90 or less, preferably, less than 80 and most preferably less than 75, and the overall ball has a similar PGA® compression. The hardness of the cover is adjusted so that it is soft enough that the PGA® compression of the ball is the same or lower than the core compression. The core and/or the ball may also be treated, such as with gamma radiation, to additionally improve the finished properties of the ball, such as C.O.R., scuff and melt resistance.

The polybutadiene rubbers preferably used in the particular combination include a first polybutadiene rubber that is obtained utilizing a cobalt catalyst and which exhibits a Mooney viscosity in the range of from about 70 to about 83. The combination of polybutadiene rubbers also includes a second polybutadiene rubber that is obtained utilizing a neodymium series catalyst and which exhibits a Mooney viscosity of from about 30 to about 70. The second polybutadiene rubber may comprise a blend of one or more neodymium catalyst rubbers. Optionally, one or more heavy weight fillers can be included in the core composition to further enhance the spin rate characteristics.

The preferred cover compositions used in the golf ball of this aspect include combinations of hard and/or soft resinous materials, such as ionomeric resins. These ionomers are blended to produce a soft, yet durable, cover.

In an additional aspect, the present invention provides a golf ball comprising a core that includes a particular combination of first and second polybutadiene rubbers, in particular weight proportions, and a cover generally enclosing the core which is formed from a certain combination of ionomers. Specifically, the core includes from about 30% by weight of a first polybutadiene rubber obtained from a cobalt or cobalt-based catalyst, and about 30% to about 45% by weight of a second polybutadiene rubber obtained from a neodymium or lanthanide-series catalyst. The second polybutadiene rubber may comprise a blend of one or more neodymium and/or lanthanide-series catalyst rubbers.

The cover of the golf ball of this aspect includes a blend of a sodium ionomer and a zinc ionomer. The cover and overall ball can be irradiated (i.e., gamma treatment) to enhance various characteristics of the ball.

In yet another aspect, the present invention provides a golf ball comprising a core including a certain combination of polybutadiene rubbers, which is enclosed with a cover formed from a particular set of ionomers. The core includes from about 20% to about 30% by weight of a first polybutadiene rubber obtained from a cobalt catalyst and which exhibits a Mooney viscosity in the range of from about 70 to about 83. The core further includes from about 30% to about 45% of a second polybutadiene rubber obtained from a neodymium catalyst and which exhibits a Mooney viscosity of from about 30 to about 70. The second polybutadiene rubber may comprise a blend of one or more neodymium catalyst rubbers.

An ionomeric cover is then disposed about the core. This produces a relatively soft covered golf ball having a low PGA® compression and a high spin rate potential.

Further scope of the applicability of the invention will become apparent from the detailed description provided below.

BRIEF DESCRIPTION OF THE DRAWINGS

The following is a brief description of the drawings, which are presented for the purposes of illustrating the invention and not for the purposes of limiting the same.

DETAILED DESCRIPTION OF THE PREFERRED EMBODIMENTS

Figure 1:
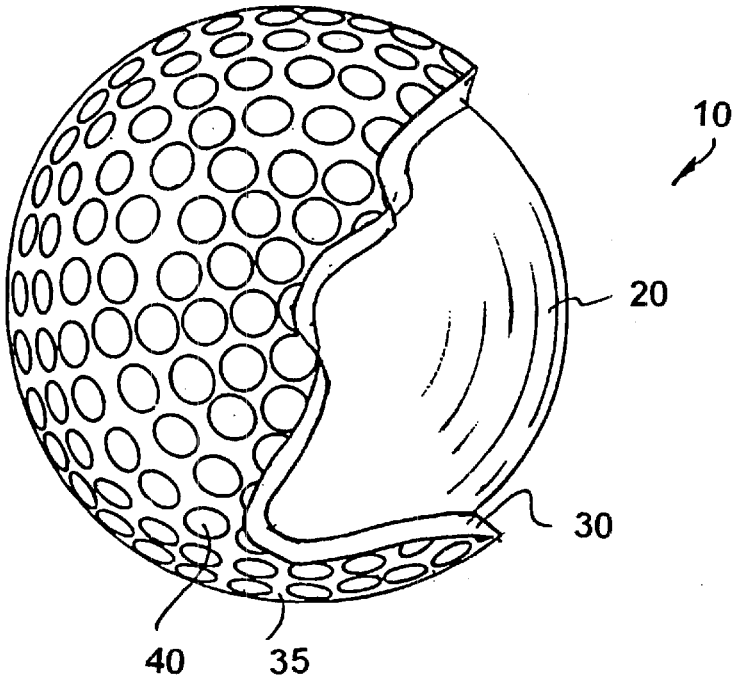
FIG. 1 is a partial sectional view of a preferred embodiment of the golf ball in accordance with the present invention having a unitary, solid core and an outer cover layer.

The present invention provides a new, improved class of high spinning golf balls and/or a method of making the same. As described herein, these golf balls feature soft, yet durable, solid cores that exhibit high resilience and soft, durable covers. Preferably, the cores comprise high molecular weight polybutadiene or other high resiliency rubbers, and the covers comprise a specific array of soft resinous materials, such as a blend of highly durable hard and/or soft ionomer resins.

The balls of the invention are constructed in such a manner that the cores and resulting balls are relatively soft. The hardness of the cover is soft enough so that the PGA® compression of the overall ball is substantially the same or lower than the core compression. Consequently, the cover, subsequent to molding, does not increase the PGA® compression of the balls.

The core size and cover hardness of the balls of the invention are selected, or matched, in such a manner as to obtain the desired high spin rate.

In this regard, it has been found that larger cores produce lower spin rates and higher C.O.R.'s, and softer covers produce higher spin rates. Optionally, the weight of the cores and covers can be adjusted to change the spin rate characteristics.

Additionally, the cores and covers can also be gamma treated (such as at 30 to 50 kgys) in order to further improve such properties as C.O.R., scuff and melt resistance. Preferably, the golf balls are produced utilizing a relatively large diameter core (i.e., 1.54"–1.58" core) and a soft cover (Shore® D hardness of about 63 or less, preferably 55 or less and most preferably about 53±2 post gamma treatment).

In a particular aspect, the golf balls of the present invention have a relatively large diameter (preferably about 1.560±0.008 inches) solid core. The cores exhibit a weight of about 37.5±0.04 grams. This weight can be increased to further enhance the spin rate of the balls. However, this may be offset with a decrease in resilience, compression, etc.

The cores in this particular aspect of the invention have a coefficient of restitution (pre-gamma treatment) of at least about 0.780 (preferably, at least about 0.790 and most preferably 0.800 or more) and a PGA® compression of 80 or less (preferably, 60 or less, most preferably 55 or less). The cores exhibit a core surface hardness of Shore® C of 82±2 or less and/or a Shore® D hardness of 60±2 or less. The cores have a Shore® C center hardness of about 71±4.

Furthermore, with respect to post-gamma treatment characteristics, the cores exhibit a coefficient of restitution of at least 0.795 (preferably 0.800 or more, and most preferably 0.805 or more) and a PGA® compression of 90 or less (preferably, 80 or less, and most preferably 75 or less). The post-gamma treated cores have a core surface hardness of Shore® C of 85±2 or less and a Shore® D hardness of 52±2 or less.

A soft, durable and relatively thin (0.063±0.005 inches) cover material is then disposed over the core to produce a ball 1.680 inches or larger in diameter weighing no more than 1.620 ounces. After gamma treatment (30–50 kgys, preferably 40 kgys), the balls of the invention exhibit an overall coefficient of restitution of greater than 0.795, preferably greater than 0.800 and most preferably greater than 0.805 and a PGA® compression of less than 90, preferably less than 80 and most preferably 73 or less. The post gamma treated balls exhibit a Shore® C cover hardness of 68–79 and/or a Shore® D cover hardness of 43–55 as measured on the ball. The balls also exhibit a moment of inertia of 0.4000–0.4500.

Figure 2:
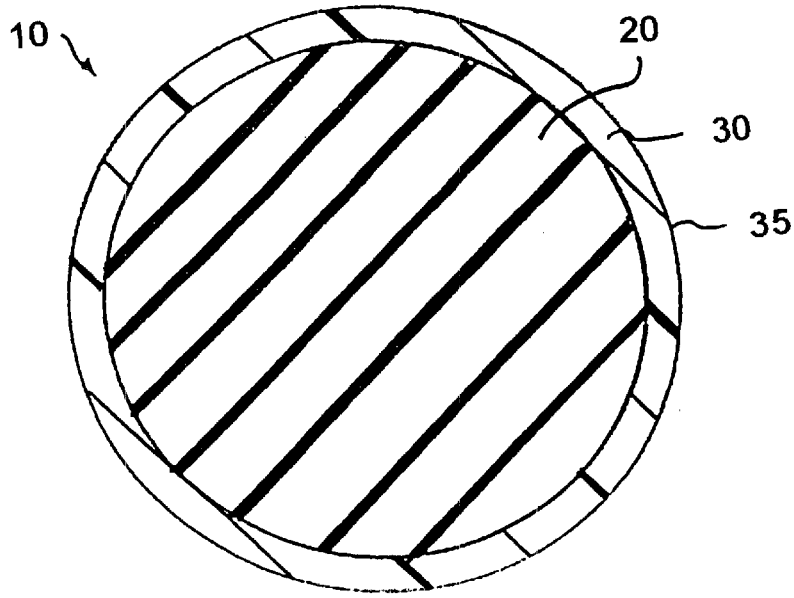
FIG. 2 is a cross sectional view of the preferred embodiment of the golf ball of FIG. 1.

Referring to the drawings, see FIGS. 1 and 2, a golf ball produced according to the present invention is shown and designated as 10. It should be understood that all of the figures are schematics and are not drawn necessarily to scale. The golf ball 10 has a solid core 20. A dimpled cover outer cover layer 30 surrounds core 20. The outer cover layer 30 defines a plurality of dimples 40 and an outer surface 35 to form an unfinished ball.

One or more thin primer coats can then be applied to the outer surface of cover layer 24. A thin top coat (not shown) surrounds the primer coat to form the finished ball. Optionally, one or more pigmented paint coat(s) can be substituted for the primer coat and/or top coat.

The performance characteristics of the balls of the invention show that these balls are high spinning balls. The balls exhibit spin rates comparable to that of the high spinning, three-piece wound ball, the Titleist® Tour Balata produced by the Acushnet Company, of Massachusetts. Despite the very high spin rates, the distance results of the balls of the invention met or exceeded expectations, with the pro driver distance being comparable or longer than that of the competitive set. The 5 iron distance results were also comparable to that of competitive wound balls, such at the Titleist® Tour Balata and Tour Prestige. From machine and limited player testing, the ball flight/trajectory of the invention approaches that of a Titleist® Tour Balata wound ball and can be described as being a "rising" trajectory versus a "boring" or "penetrating" trajectory.

The particular manner of construction of the invention and the results produced thereby, are more specifically discussed below.

Cores

The present invention is directed to improved compositions which, when utilized in formulating golf ball cores, produce soft, yet durable, cores that exhibit a relatively high degree of resilience. Preferably, the cores are relatively large in size.

The invention is also directed to improving the processability of polybutadiene, particularly in forming golf ball cores. In this regard, it has been found that the use of a blend of particular polybutadiene resins in a golf ball core composition has the effect of increasing the resiliency of the resultant cores and greatly facilitates core formation while maintaining core durability.

The compositions of the present invention comprise one or more rubber or elastomeric components and an array of non-rubber or non-elastomeric components. The rubber components of the core compositions of the invention comprise a particular polybutadiene synthesized with cobalt and having an ultra-high Mooney viscosity and certain molecular weight characteristics described in detail below, one or more particular polybutadienes synthesized with neodymium, and one or more other optional polybutadienes.

The non-rubber components of the core compositions of the invention comprise one or more crosslinking agents which preferably include an unsaturated carboxylic acid component, a free radical initiator to promote cross linking, one or more optional modifying agents, fillers, moldability additives, processing additives, and dispersing agents, all of which are described in greater detail below.

The first preferred polybutadiene resin for use in the present invention composition has a relatively ultra high Mooney viscosity. A "Mooney unit" is an arbitrary unit used to measure the plasticity of raw, or unvulcanized rubber. The plasticity in Mooney units is equal to the torque, measured on an arbitrary scale, on a disk in a vessel that contains rubber at a temperature of 212° F. (100° C.) and that rotates at two revolutions per minute.

The measurement of Mooney viscosity, i.e. Mooney viscosity [$ML_{1+4}$(100° C.], is defined according to the standard ASTM® D-1646, herein incorporated by reference. In ASTM® D-1646, it is stated that the Mooney viscosity is not a true viscosity, but a measure of shearing torque over a range of shearing stresses. Measurement of Mooney viscosity is also described in the *Vanderbilt Rubber Handbook,* 13th Ed., (1990), pages 565–566, also herein incorporated by reference. Generally, polybutadiene rubbers have Mooney viscosities, measured at 212° F., of from about 25 to about 65. Instruments for measuring Mooney viscosities are commercially available such as a Monsanto Mooney Viscometer, Model MV 2000. Another commercially available device is a Mooney viscometer made by Shimadzu Seisakusho Ltd.

As will be understood by those skilled in the art, polymers may be characterized according to various definitions of molecular weight. The "number average molecular weight," $M_n$, is defined as:

$$M_n = \frac{\sum W_i}{\sum W_i / M_i}$$

where $W_i$ is the molecular weight of a fraction or sample of the polymer and $M_i$ is the total number of fractions or samples.

"Weight average molecular weight," $M_w$ is defined as:

$$M_w = \frac{\sum W_i M_i}{\sum W_i}$$

where $W_i$ and $M_i$ have the same meanings as noted above.

The "Z-average molecular weight," $M_z$, is defined as:

$$M_z = \frac{\sum W_i M_i^2}{\sum W_i M_i}$$

where $W_i$ and $M_i$ have the same meanings as noted above.

"$M_{peak}$" is the molecular weight of the most common fraction or sample, i.e. having the greatest population.

Considering these various measures of molecular weight, provides an indication of the distribution or rather the "spread" of molecular weights of the polymer under review.

A common indicator of the degree of molecular weight distribution of or of a polymer is its "polydispersity", P:

$$P = \frac{M_w}{M_n}$$

Polydispersity, also referred to as "dispersity", also provides an indication of the extent to which the polymer chains share the same degree of polymerization. If the polydispersity is 1.0, then all polymer chains must have the same degree of polymerization. Since weight average molecular weight is always equal to or greater than the number average molecular weight, polydispersity, by definition, is equal to or greater than 1.0:

$$P \geq 1.0$$

The first particular polybutadiene for use in the preferred embodiment compositions of the present invention exhibits a Mooney viscosity of from about 65 to about 85, and preferably from about 70 to about 83. The first particular polybutadiene has a number average molecular weight $M_n$ of from about 90,000 to about 130,000; and preferably from about 100,000 to about 120,000. The first particular polybutadiene has a weight average molecular weight $M_w$ of from about 250,000 to about 350,000; and preferably from about 290,000 to about 310,000. The first particular polybutadiene has a Z-average molecular weight $M_z$ of about 600,000 to about 750,000; and preferably from about 660,000 to about 700,000. The first particular polybutadiene has a peak molecular weight $M_{peak}$ of about 150,000 to about 200,000; and preferably from about 170,000 to about 180,000.

The polydispersity of the first particular polybutadiene for use in the preferred embodiment compositions typically ranges from about 1.9 to about 3.9; and preferably from about 2.4 to about 3.1. Most preferably, the polydispersity is about 2.7.

The first particular polybutadiene for use in the preferred embodiment compositions preferably contains a majority fraction of polymer chains containing a cis-1,4 bond, more preferably, having a cis-1,4 polybutadiene content of about 90%, and most preferably, having a cis-1,4 polybutadiene content of at least about 95%. Another characteristic of the first preferred polybutadiene is that it is obtained or synthesized by utilizing a cobalt or cobalt-based catalyst.

A commercially available polybutadiene corresponding to the noted first preferred ultra high viscosity polybutadiene, and which is suitable for use in the preferred embodiment compositions in accordance with the present invention is available under the designation Cariflex® BCP 820, from Shell Chimie of France. Although this polybutadiene produces cores exhibiting higher C.O.R. values, it is somewhat difficult to process using conventional equipment. The properties and characteristics of this preferred polybutadiene are set forth below in Table 1.

TABLE 1

Properties of Shell Chimie BCP 820 (Also known As BR-1202J)

| Property | Value | |
|---|---|---|
| Mooney Viscosity (approximate) | 70–83 | |
| Volatiles Content | 0.5% maximum | |
| Ash Content | 0.1% maximum | |
| Cis 1,4-polybutadiene Content | 95.0% minimum | |
| Stabilizer Content | 0.2 to 0.3% | |
| Polydispersity | 2.4–3.1 | |
| Molecular Weight Data: | Trial 1 | Trial 2 |
| $M_n$ | 110,000 | 111,000 |
| $M_w$ | 300,000 | 304,000 |
| $M_z$ | 680,000 | |
| $M_{peak}$ | 175,000 | |

The second polybutadiene for use in the preferred embodiment golf ball core compositions is a polybutadiene that is obtained or synthesized by utilizing a neodymium or lanthanide series catalyst, and that exhibits a Mooney viscosity of from about 30 to about 70, preferably from about 35 to about 70, more preferably from about 40 to about 65, and most preferably from about 45 to about 60. While the second polybutadiene provides covers exhibiting higher C.O.R. values, it exhibits very poor cold flow properties and very high dry swell characteristics.

Examples of such second polybutadienes obtained by using a neodymium-based catalyst include Neo Cis 40 and Neo Cis 60 from Enichem and CB-22, CB-23, and CB-24 from Bayer. The properties of these polybutadienes are given below.

TABLE 2

Properties of Neo Cis

| | |
|---|---|
| Properties of Raw Polymer | |
| Microstructure | |
| 1,4 cis (typical) | 97.5% |
| 1,4 trans (typical) | 1.7% |
| Vinyl (typical) | 0.8% |
| Volatile Matter (max) | 0.75% |
| Ash (max) | 0.30% |
| Stabilizer (typical) | 0.50% |
| Mooney Viscosity, ML 1 + 4 at 100° C. | 38–48 and 60–66 |
| Properties of compound (typical) | |
| Vulcanization at 145° C. | |
| Tensile strength, 35' cure, | 16 MPa |
| Elongation, 35' cure, | 440% |
| 300% modulus, 35' cure, | 9.5 MPa |

TABLE 3A

Properties of CB-22

| TESTS | RESULTS | SPECIFICATIONS |
|---|---|---|
| 1. Mooney-Viscosity | | |
| ML1 + 4 100 Cel/ASTM ® -sheet | | |
| ML1 + 1 Minimum | 58 | MIN. 58 ME |
| Maximum | 63 | MAX. 68 ME |
| Median | 60 | 58–68 ME |

TABLE 3A-continued

Properties of CB-22

| TESTS | RESULTS | SPECIFICATIONS |
|---|---|---|
| 2. Content of ash | | |
| DIN 53568 | | |
| Ash | 0.1 | MAX. 0.5% |
| 3. Volatile matter | | |
| heating 3 h/105 Cel | | |
| Loss in weight | 0.11 | MAX. 0.5% |
| 4. Organic acid | | |
| Bayer Nr. 18 | | |
| Acid | 0.33 | MAX. 1.0% |
| 5. CIS-1,4 content | | |
| IR-spectroscopy | | |
| CIS 1,4 | 97.62 | MIN. 96.0% |
| 6. Vulcanization behavior | | |
| Monsanto MDR/160 Cel | | |
| DIN 53529 | | |
| Compound after | | |
| ts01 | 3.2 | 2.5–4.1 min |
| t50 | 8.3 | 6.4–9.6 min |
| t90 | 13.2 | 9.2–14.0 min |
| s'min | 4.2 | 3.4–4.4 dN.m |
| s'max | 21.5 | 17.5–21.5 dN.m |
| 7. Informative data | | |
| Vulcanization 150 Cel 30 min | | |
| Tensile | ca. 15,0 | |
| Elongation at break | ca. 450 | |
| Stress at 300% elongation | ca. 9,5 | |

TABLE 3B

Properties of CB-23

| TESTS | RESULTS | SPECIFICATIONS |
|---|---|---|
| 1. Mooney-Viscosity | | |
| ML1 + 4 100 Cel/ASTM ® -sheet | | |
| ML1 + 1 Minimum | 50 | MIN. 46 ME |
| Maximum | 54 | MAX. 56 ME |
| Median | 51 | 46–56 ME |
| 2. Content of ash | | |
| DIN 53568 | | |
| Ash | 0.09 | MAX. 0.5% |
| 3. Volatile matter | | |
| DIN 53526 | | |
| Loss in weight | 0.19 | MAX. 0.5% |
| 4. Organic acid | | |
| Bayer Nr. 18 | | |
| Acid | 0.33 | MAX. 1.0% |
| 5. CIS-1,4 content | | |
| IR-spectroscopy | | |
| CIS 1,4 | 97.09 | MIN. 96.0% |
| 6. Vulcanization behavior | | |
| Monsanto MDR/160 Cel | | |
| DIN 53529 | | |
| Compound after | MIN. 96.0 | |
| ts01 | 3.4 | 2.4–4.0 min |
| t50 | 8.7 | 5.8–9.0 min |
| t90 | 13.5 | 8.7–13.5 min |
| s'min | 3.1 | 2.7–3.8 dN.m |
| s'max | 20.9 | 17.7–21.7 dN.m |

TABLE 3B-continued

| Properties of CB-23 | | |
|---|---|---|
| TESTS | RESULTS | SPECIFICATIONS |
| 7. Vulcanization test with ring | | |
| Informative data | | |
| Tensile | ca 15,5 | |
| Elongation at break | ca. 450 | |
| Stress at 300% elongation | ca. 9,3 | |

TABLE 3C

| Properties of CB-24 | | |
|---|---|---|
| TESTS | RESULTS | SPECIFICATIONS |
| 1. Mooney-Viscosity | | |
| ML1 + 4 100 Cel/ASTM ® -sheet | | |
| ML1 + 1 Minimum | 44 | MIN. 39 ME |
| Maximum | 46 | MAX. 49 ME |
| Median | 45 | 39–49 ME |
| 2. Content of ash | | |
| DIN 53568 | | |
| Ash | 0.12 | MAX. 0.5% |
| 3. Volatile matter | | |
| DIN 53526 | | |
| Loss in weight | 0.1 | MAX. 0.5% |
| 4. Organic acid | | |
| Bayer Nr. 18 | | |
| Acid | 0.29 | MAX. 1.0% |
| 5. CIS-1,4 content | | |
| IR-spectroscopy | | |
| CIS 1,4 | 96.73 | MIN. 96.0% |
| 6. Vulcanization behavior | | |
| Monsanto MDR/160 Cel | | |
| DIN 53529 | | |
| Compound after masticator | | |
| ts01 | 3.4 | 2.6–4.2 min |
| t50 | 8.0 | 6,2–9,4 min |
| t90 | 12.5 | 9,6–14,4 min |
| s'min | 2.8 | 2.0–3.0 dN.m |
| s'max | 19.2 | 16.3–20.3 dN.m |
| 7. Informative data | | |
| Vulcanization 150 Cel 30 min | | |
| Tensile | ca 15,0 | |
| Elongation at break | ca. 470 | |
| Stress at 300% elongation | ca. 9,1 | |

It has been found that when the first and second polybutadienes are blended together within certain ranges, golf ball cores can be produced without the individual processing difficulties associated with each polybutadiene. This is shown in more detail below in the Example. In essence, a synergistic effect is produced allowing the blends to produce golf ball cores using conventional equipment exhibiting enhanced resilience.

Although less desirable, the compositions of the present invention may also utilize in minor amounts other polybutadiene resins in addition to the noted first and second particular polybutadienes. For example, Cariflex® BR-1220 polybutadiene available from Shell Chemical (see Table 4 below); and Taktene® 220 polybutadiene available from Bayer Corp. of Orange, Tex. (see Tables 5A and 5B below) may be utilized as other polybutadienes in combination with the particular ultra-high Mooney viscosity polybutadiene components described herein. Generally, these other polybutadienes have Mooney viscosities in the range of about 25 to 65. It is also contemplated that a similar polybutadiene resin, BCP 819, commercially available from Shell Chimie, may be used in conjunction with BCP 820.

TABLE 4

Properties of Cariflex ® BR-1220 Polybutadiene

Physical Properties:

Polybutadiene Rubber
CIS 1,4 Content - 97%–99% Min.
Stabilizer Type - Non Staining
Total Ash - 0.5% Max.
Specific Gravity - 0.90–0.92
Color - Transparent, clear, Lt. Amber
Moisture - 0.3% max. ASTM ® 1416.76 Hot Mill Method
Polymer Mooney Viscosity - (35–45 Cariflex ®) (ML1 + 4 @ 212° F.)
90% Cure - 10.0–13.0
Polydispersity 2.5–3.5

| Molecular Weight Data: | Trial 1 | Trial 2 |
|---|---|---|
| $M_n$ | 80,000 | 73,000 |
| $M_w$ | 220,000 | 220,000 |
| $M_z$ | 550,000 | |
| $M_{peak}$ | 110,000 | |

TABLE 5A

Properties of Taktene ® 220 Polybutadiene

Physical Properties:

Polybutadiene Rubber
CIS 1, 4 Content (%) - 98% Typical
Stabilizer Type - Non Staining 1.0–1.3%
Total Ash - 0.25 Max.
Raw Polymer Mooney Visc. –35–45 40 Typical
(ML1 + 4' @ 212 Deg. F./212° F.)
Specific Gravity - 0.91
Color - Transparent - almost colorless (15 APHA Max.)
Moisture % - 0.30% Max. ASTM ® 1416-76 Hot Mill Method

TABLE 5B

Properties of Taktene ® 220 Polybutadiene

Product Description: A low Mooney viscosity, non-staining, solution polymerized, high cis-1,4-polybutadiene rubber.

| Property | Range | Test Method |
|---|---|---|
| Raw Polymer Properties | | |
| Mooney viscosity 1 + 4 (212° F.) | 40 ± 5 | ASTM ® D 1646 |
| Volatile matter (wt %) | 0.3 max. | ASTM ® D 1416 |
| Total Ash (wt %) | 0.25 max. | ASTM ® D 1416 |
| Cure(1)(2) Characteristics | | |
| Minimum torque | | |
| $M_L$ (dN.m) | 9.7 ± 2.2 | ASTM ® D 2084 |
| (lbf).in) | 8.6 ± 1.9 | ASTM ® D 2084 |
| Maximum torque | | |
| $M_H$ (dN.m) | 35.7 ± 4.8 | ASTM ® D 2084 |
| (lbf.in) | 31.6 ± 4.2 | ASTM ® D 2084 |
| $t_21$ (min) | 4 ± 1.1 | ASTM ® D 2084 |
| t'50 (min) | 9.6 ± 2.5 | ASTM ® D 2084 |
| t'90 (min) | 12.9 ± 3.1 | ASTM ® D 2084 |

TABLE 5B-continued

| Other Product Features | |
|---|---|
| Property | Typical Value |
| Specific gravity | 0.91 |
| Stabilizer type | Non-staining |

(1)Monsanto Rheometer at 160° C., 1.7 Hz (100 cpm), 1 degree arc, micro-die
(2)Cure characteristics determined on ASTM ® D 3189 MIM mixed compound:

| | |
|---|---|
| TAKTENE ® 220 | 100 (parts by mass) |
| Zinc oxide | 3 |
| Stearic acid | 2 |
| IRB #6 black (N330) | 60 |
| Naphthenic oil | 15 |
| TBBS | 0.9 |
| Sulfur | 1.5 |

* This specification refers to product manufactured by Bayer Corp., Orange, Texas, U.S.A.

Concerning the elastomeric or rubber portion of the preferred embodiment compositions, it is preferred to utilize the previously described first and second polybutadienes in particular proportions to one another. Generally, it is preferred to utilize the first polybutadiene in a proportion of less than 50 parts per hundred parts of the total amount of the first and second polybutadienes. Unless indicated otherwise, all parts expressed herein are parts by weight. More preferably, the first polybutadiene is utilized in a proportion of about 45 parts or less (most preferably 40 parts or less) per hundred parts of the total amount of the first and second polybutadienes.

With respect to the second polybutadiene, it is generally preferred to utilize the second polybutadiene in a proportion of more than 50 parts per hundred parts of the total amount of the first and second polybutadienes. More preferably, the second polybutadiene is utilized in a proportion of about 55 parts or more (most preferably 60 parts or more) per hundred parts of the total amount of the first and second polybutadienes.

The preferred embodiment core compositions of the present invention generally comprise from about 80 parts to about 120 parts by weight of elastomeric or rubber components, i.e. the first and second polybutadienes, and from about 60 to about 80, or more, parts by weight of non-rubber or non-elastomeric components. Preferably, the core compositions comprise about 100 parts of rubber components and from about 60 to about 80, or more, parts by weight of non-rubber components. It will be understood that depending upon the types and respective function of components added to the non-rubber portion of the preferred embodiment core compositions, that the non-rubber portion may constitute a significant proportion of the rubber component. The rubber components include the previously described first and second polybutadienes. The non-rubber components are generally described below.

Preferably, the crosslinking agent of the core composition is an unsaturated carboxylic acid component which is the reaction product of a carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the preferred core compositions are acrylic acid, methacrylic acid, itaconic acid, crotonic acid, sorbic acid, and the like, and mixtures thereof. Preferably, the acid component is either acrylic or methacrylic acid. Usually, from about 15 to about 50, and preferably from about 20 to about 35 parts by weight of the carboxylic acid salt, such as zinc diacrylate, is included per 100 parts of the rubber components in the core composition. The unsaturated carboxylic acids and metal salts thereof are generally soluble in the elastomeric base, or are readily dispersible.

The free radical initiator included in the core composition is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 and preferably in amounts of from about 0.3 to about 3.0 parts by weight per each 100 parts of elastomer.

Exemplary of suitable peroxides for the purposes of the present 3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercial available peroxides are Luperco® 230 or 231 XL, a peroxyketal manufactured and sold by Atochem, Lucidol Division, Buffalo, N.Y., and Trigonox® 17/40 or 29/40, a peroxyketal manufactured and sold by Akzo Chemie America, Chicago, Ill. The one hour half life of Luperco® 231 XL and Trigonox® 29/40 is about 112° C., and the one hour half life of Luperco® 230 XL and Trigonox® 17/40 is about 129° C. Luperco® 230 XL and Trigonox® 17/40 are n-butyl4,4-bis(t-butylperoxy) valerate and Luperco® 231 XL and Trigonox® 29/40 are 1,1-di(t-butylperoxy)3,3,5-trimethyl cyclohexane. Most preferably, and as noted in Table 6 herein, Trigonox® 4240B from Akzo Nobel of Chicago, Ill. is used. Most preferably, a solid form of this peroxide is used. Trigonox® 42–40B is tert-Butyl peroxy-3,5,5-trimethylhexanoate. The liquid form of this agent is available from Akzo under the designation Trigonox® 42S.

The core compositions of the present invention may additionally contain any other suitable and compatible modifying ingredients including, but not limited to, metal oxides, fatty acids, and diisocyanates. For example, Papi® 94, a polymeric diisocyanate, commonly available from Dow Chemical Co., Midland, Mich., is an optional component in the rubber compositions. It can range from about 0 to 5 parts by weight per 100 parts by weight rubber (phr) component, and acts as a moisture scavenger.

Various activators may also be included in the compositions of the present invention. For example, zinc oxide and/or magnesium oxide are activators for the polybutadiene. The activator can range from about 2 to about 10 parts by weight per 100 parts by weight of the rubbers (phr) component.

Moreover, filler-reinforcement agents may be added to the composition of the present invention. One such example is polypropylene powder. Since the specific gravity of polypropylene powder is very low, and when compounded, the polypropylene powder produces a lighter molded core, large amounts of higher gravity fillers may be added. Additional benefits may be obtained by the incorporation of relatively large amounts of higher specific gravity, inexpensive mineral fillers such as calcium carbonate. Such fillers as are incorporated into the core compositions should be in finely divided form, as for example, in a size generally less than about 30 mesh and preferably less than about 100 mesh U.S. standard size. The amount of additional filler included in the core composition is primarily dictated by weight restrictions and preferably is included in amounts of from about 10 to about 100 parts by weight per 100 parts rubber.

The preferred fillers are relatively inexpensive and heavy and serve to increase the spin rate of the ball, lower the cost of the ball, and/or increase the weight of the ball to closely approach the U.S.G.A. weight limit of 1.620 ounces. Exemplary fillers include mineral fillers such as limestone, zinc oxide, silica, mica, barytes, calcium carbonate, or clays. Limestone is ground calcium/magnesium carbonate and is used because it is an inexpensive, heavy filler. Other heavy filler include metal particles, such as powdered tungsten, bismuth, or molybdenum.

In this regard, also optionally included in the matrix materials of the core are one or more heavy weight fillers or powder materials. Such a core will exhibit a lower moment of inertia.

The powdered metal in the core may be in a wide array of types, geometries, forms, and sizes. The powdered metal may be of any shape so long as the metal may be blended with the other components which form the core.

Particularly, the metal may be in the form of metal particles, metal flakes, and mixtures thereof. However, again, the forms of powdered metal are not limited to such forms. The metal may be in a form having a variety of sizes so long as the objectives of the present invention are maintained. Preferably, the powdered metal is incorporated into the matrix material of the core in finely defined form, as for example, in a size generally less than about 20 mesh, preferably less than about 200 mesh and most preferably less than about 325 mesh, U.S. standard size. The amount of powdered metal included in the core is dictated by weight restrictions, the type of powdered metal, and the overall characteristics of the finished ball.

The core may include more than one type of powdered metal. Particularly, the core may include blends of the powdered metals disclosed below. The blends of powdered metals may be in any proportion with respect to each other in order for the core and golf ball to exhibit the characteristics noted herein. Preferably, the particles (or flakes, fragments, fibers, etc.) of powdered metal are added to the inner spherical core in order to decrease the moment of inertia of the ball without affecting the ball's feel and durability characteristics.

The core is filled with one or more reinforcing or non-reinforcing heavy weight fillers such as metal (or metal alloy) powders. Representatives of such metal (or metal alloy) powders include but are not limited to, tungsten powder, bismuth powder, boron powder, brass powder, bronze powder, cobalt powder, copper powder, inconnel metal powder, iron metal powder, molybdenium powder, nickel powder, stainless steel powder, titanium metal powder, zirconium oxide powder, aluminum flakes, and aluminum tadpoles.

Examples of several suitable powdered metals which can be included in the present invention are as follows:

| Metals and Alloys (Powders) | Specific Gravity |
|---|---|
| titanium | 4.51 |
| tungsten | 19.35 |
| bismuth | 9.78 |
| nickel | 8.90 |
| molybdenum | 10.2 |
| iron | 7.86 |
| copper | 8.94 |
| brass | 8.2–8.4 |
| bronze | 8.70–8.74 |
| cobalt | 8.92 |
| zinc | 7.14 |
| tin | 7.31 |
| aluminum | 2.70 |

The amount and type of powdered metal utilized is dependent upon the overall characteristics of the high spinning, soft feeling, golf ball desired. Generally, lesser amounts of high specific gravity powdered metals are necessary to produce a decrease in the moment of inertia in comparison to low specific gravity materials. Furthermore, handling and processing conditions can also effect the type of heavy weight powdered metals incorporated into the core. Additional density adjusting fillers are discussed in more detail below in the Definition section.

Moreover, as indicated, ground flash filler may also be incorporated into the core composition. It is preferably 20 mesh ground up center stock from the excess flash from compression molding. It lowers the cost and may increase the hardness of the ball.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid, palmitic, oleic and linoleic acids, as well as mixtures thereof. Exemplary of suitable metallic salts of fatty acids include zinc stearate. When included in the core compositions, the fatty acid component is present in amounts of from about 1 to about 25, preferably in amounts from about 20 to about 15 parts by weight based on 100 parts rubber (elastomer). It is preferred that the core compositions include stearic acid as the fatty acid adjunct in an amount of from about 2 to about 5 parts by weight per 100 parts of rubber.

Diisocyanates may also be optionally included in the core compositions when utilized, the diisocyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbonates set forth in U.S. Pat. No. 4,852,884 may also be incorporated into the polybutadiene compositions of the present invention. The specific types and amounts of such additives are set forth in the above-identified patents, which are incorporated herein by reference.

The golf ball core compositions of the invention may also comprise from about 1 to about 100 parts by weight of particulate polypropylene resin, and preferably from about 10 to about 100 parts by weight polypropylene powder resin, per 100 parts by weight of a base elastomer (or rubber) selected from polybutadiene and mixtures of polybutadiene with other elastomers. More preferably, the particulate polypropylene resin, if utilized in the core compositions of the present invention, comprises from about 20 to about 40 parts by weight of a polypropylene powder resin such as that trademarked and sold by Amoco Chemical Co. under the designation "6400 P", "7000P" and "7200 P". The ratios of the ingredients may vary and are best optimized empirically.

As indicated above, additional suitable and compatible modifying agents such as fatty acids, and secondary additives such as Pecan shell flour, ground flash (i.e. grindings from previously manufactured cores of substantially identical construction), barium sulfate, zinc oxide, etc. may be added to the core compositions to increase the weight of the ball as desired in order to increase the spin rate and/or to have the ball reach or closely approach the U.S.G.A. weight limit of 1.620 ounces.

Examples of core formulations in accordance with the present invention are as follows in Tables 6A–6B:

TABLE 6A

Core Formulation A

| Ingredients | Parts | Wt % |
|---|---|---|
| Cariflex ® 1220x(BCP-820) | 40 | 24.64 |
| Neo Cis 60 | 30 | 18.48 |
| Neo Cis 40 | 30 | 18.48 |
| Zinc Oxide | 24 | 14.78 |
| Tungsten Powder | 0.17 | 0.105 |
| Zinc Stearate | 16.3 | 10.04 |
| Zinc Diacrylate (ZDA) | 20.5 | 12.63 |
| Red MB | 0.14 | 0.086 |
| Triganox 42-40B | 1.24 | 0.76 |
| Total | 162.4 | 100 |

TABLE 6B

Core Formulations B & C

| | B | | C | |
|---|---|---|---|---|
| Materials | Parts | Wt % | Parts | Wt % |
| BCP 820 | 40 | 0.2453235 | 40 | 0.245 |
| Neo Cis 40 | 30 | 0.1839926 | 30 | 0.184 |
| Neo Cis 60 | 30 | 0.1839926 | 30 | 0.184 |
| Zinc Oxide | 23.3 | 0.142901 | 22.8 | 0.140 |
| ZDA | 22.5 | 0.1379945 | 23.3 | 0.143 |
| Zinc Sterate | 16 | 0.0981294 | 16 | 0.098 |
| Trig 42-40 B | 1.25 | 0.0076664 | 1.25 | 0.008 |
| Total | 163.05 | 100 | 163.35 | 100 |

In these core formulations, it will be noted that the weight ratio of the first polybutadiene formed from the cobalt catalyst (Cariflex® BCP-820) to the second polybutadiene formed from the neodymium catalyst (Neo Cis 60 and Neo Cis 40) is about 2:3. The present invention includes a wide range of such ratios, such as from 1:10 to 10:1. Preferably, the amount of the cobalt catalyst polybutadiene ranges from about 20% to about 30% of the core formulation. And, preferably, the amount of the neodymium catalyst polybutadiene ranges from about 30% to about 45% of the core formulation. Most preferably, these polybutadienes are in amounts of 25% and 37%, respectively.

In producing golf ball cores utilizing the present compositions, the ingredients may be intimately mixed using, for example, two roll mills or a Banbury® mixer until the composition is uniform, usually over a period of from about 5 to about 20 minutes. The sequence of addition of components is not critical. A preferred blending sequence is as follows.

The elastomer, powder resin, fillers, zinc salt, metal oxide, fatty acid, and any other optional components, if desired, are blended for about 7 minutes in an internal mixer such as a Banbury® mixer. As a result of shear during mixing, the temperature rises to about 200° F., whereupon the batch is discharged onto a two roll mill, mixed for about one minute and sheeted out.

The sheet is then placed in a Barwell™ preformer and slugs are produced. The slugs are then subjected to compression molding at about 320° F. for about 14 minutes. After molding and cooling, the cooling effected at room temperature for about 4 hours, the molded cores are optionally subjected to a centerless grinding operation whereby a thin layer of the molded core is removed to produce a round core having a diameter of about 1.54 to 1.58 inches. Alternatively, the cores are used in the as-molded state with no grinding needed to achieve roundness.

The mixing is desirably conducted in such a manner that the composition does not reach incipient polymerization temperatures during the blending of the various components.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. The composition can be formed into a core structure by any one of a variety of molding techniques, e.g. injection, compression, or transfer molding. When the composition is cured by heating, the time required for heating will normally be short, generally from about 10 to about 20 minutes, depending upon the particular curing agent used. Those of ordinary skill in the art relating to free radical curing agents for polymers are conversant with adjustments of cure times and temperatures required to effect optimum results with any specific free radical agent.

After molding, the core is removed from the mold and the surface thereof, may optimally be treated to facilitate adhesion thereof to the covering materials. Surface treatment, if desired, can be effected by any of the several techniques known in the art, such as corona discharge, ozone treatment, sand blasting, and the like. Preferably, surface treatment is affected, if desired, by grinding with an abrasive wheel.

Covers

The cover can be formed over the cores by injection molding, compression molding, casting or other conventional molding techniques. It is preferable to form the cover by either injection molding or compression molding.

The outer cover layer of the golf ball of the present invention is relatively soft. It is based on a single or blended resinous material. Non-limiting examples of suitable materials are ionomers (including terpolymers), cross-linked polyurethanes, plastomers such as metallocene catalyzed polyolefins, e.g., EXACT®, ENGAGE®, INSITE or AFFINITY which preferably are cross-linked, polyamides, amide-ester elastomers, graft copolymers of ionomer and polyamide such as CAPRON®, ZYTEL®, PEBAX®, etc., blends containing cross-linked transpolyisoprene, thermoplastic block polyesters such as HYTREL®, or thermoplastic or thermosetting polyurethanes, and polyureas such as ESTANE®, which is thermoplastic, and/or blends thereof.

Furthermore, the cover layer can be formed from a number of other non-ionomeric thermoplastics and thermosets. For example, lower cost polyolefins and thermoplastic elastomers can be used. Non-limiting examples of suitable non-ionomeric polyolefin materials include low density polyethylene, linear low density polyethylene, high density polyethylene, polypropylene, rubber-toughened olefin polymers, acid copolymers which do not become part of an ionomeric copolymer when used in the inner cover layer, such as PRIMACOR®, NUCREL®, ESCOR® and ATX, flexomers, thermoplastic elastomers such as styrene/butadiene/styrene (SBS) or styrene/ethylene-butylene/styrene (SEBS) block copolymers, including Kraton® (Shell), dynamically vulcanized elastomers such as Santoprene® (Monsanto), ethylene vinyl acetates such as Elvax (DuPont), ethylene methyl acrylates such as Optema (Exxon), polyvinyl chloride resins, and other elastomeric materials may be used. Mixtures, blends, or alloys involving the materials described above can be used. The non-ionomeric materials can be mixed with ionomers.

The cover layer optionally may include processing aids, release agents and/or diluents. Another useful material for any cover layer or layers is a natural rubber latex (prevulcanized) which has a tensile strength of 4,000–5,000 psi, high resilience, good scuff resistance, a Shore® D hardness of less than 15 and an elongation of 500%.

The cover has a general thickness of 0.010–0.500 inches, preferably 0.015–0.200 inches, and more preferably 0.063±0.005 inches.

The cover layers of the golf ball optionally can include fillers to adjust, for example, flex modulus, density, mold release, spin rate and/or melt flow index. A description of suitable fillers is provided below in the "Definitions" section.

The physical characteristics of the cover are such that the ball has a soft feel. The Shore® D hardness of the cover layer is less than 63 in one preferred form of the invention. Preferably, the outer cover layer has a Shore® D hardness of 60 or less, preferably 53 or less.

The composition of the cover includes the soft, low stiffness and low acid ionomers such as those sold by E.I. DuPont de Nemours & Company under the trademark "Surlyn®" and by Exxon Corporation under the trademark "Escor®" or tradename "lotek®", or blends thereof. In addition to the Surlyn® and Escor® or lotek® ionomers, the cover may comprise any ionomer which either alone or in combination with other ionomers produces a molded cover having a Shore® D hardness of 63 or less.

The soft, low acid ionomers suitable for use in the present invention are ionic copolymers which are the metal, i.e., sodium, zinc, magnesium, etc., salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (i.e., iso- or n-butylacrylate, etc.) can also be included to produce a softer terpolymer. The carboxylic acid groups of the copolymer are partially neutralized (i.e., approximately 10–75%, preferably 30–70%) by the metal ions.

As will be further noted in the Examples below, a number of ionomer resins may be used in the cover compositions, so long as the molded cover produces a Shore® D hardness of 63 or less (preferably 55 or less and most preferably about 53±2) as measured in general accordance with ASTM® method D-2240 as described in the Definition section below. Properties of some of these low acid ionomer resins sold by Exxon under the Escor® (lotek®) designation are provided in the following Table:

Typical Properties of Low Acid Escor ® (Iotek ®) Ionomers

| | ASTM ® Method | Units | 4000 | 4010 | 8000 | 8020 |
|---|---|---|---|---|---|---|
| Resin Properties | | | | | | |
| Cation type | | | zinc | zinc | sodium | sodium |
| Melt Index | D-1238 | g/10 min. | 2.5 | 1.5 | 0.8 | 1.6 |
| Density | D-1505 | $kg/m^3$ | 963 | 963 | 954 | 960 |
| Melting Point | D-3417 | ° C. | 90 | 90 | 90 | 87.5 |
| Crystallization Point | D-3417 | ° C. | 62 | 64 | 56 | 53 |
| Vicat Softening Point | D-1525 | ° C. | 62 | 63 | 61 | 64 |
| % Weight Acrylic Acid | | | 16 | — | 11 | — |
| % of Acid Groups Cation Neutralized | | | 30 | — | 40 | — |
| Plaque Properties | | | | | | |
| 3 mm thick, compression molded | | | | | | |
| Tensile at Break | D-638 | MPa | 24 | 26 | 36 | 31.5 |
| Yield Point | D-638 | MPa | none | none | 21 | 21 |
| Elongation at Break | D-638 | % | 395 | 420 | 350 | 410 |
| 1% Secant modulus | D-638 | MPa | 160 | 160 | 300 | 350 |
| Shore ® Hardness D | D-2240 | — | 55 | 55 | 61 | 58 |

| | ASTM ® Method | Units | 8030 | 7010 | 7020 | 7030 |
|---|---|---|---|---|---|---|
| Resin Properties | | | | | | |
| Cation Type | | | sodium | zinc | zinc | zinc |
| Melt Index | D-1238 | g/10 min. | 2.8 | 0.8 | 1.5 | 2.5 |
| Density | D-1505 | $kg/m^3$ | 960 | 960 | 960 | 960 |
| Melting Point | D-3417 | ° C. | 87.5 | 90 | 90 | 90 |

-continued

| Typical Properties of Low Acid Escor ® (Iotek ®) Ionomers | | | | | | |
|---|---|---|---|---|---|---|
| Crystallization Point | D-3417 | ° C. | 55 | — | — | — |
| Vicat Softening Point | D-1525 | ° C. | 67 | 60 | 63 | 62.5 |
| % Weight Acrylic Acid | | | — | — | — | — |
| % of Acid Groups Cation Neutralized | | | — | — | — | — |
| Plaque Properties (3 mm thick, compression molded) | | | | | | |
| Tensile at Break | D-638 | MPa | 28 | 38 | 38 | 38 |
| Yield Point | D-638 | MPa | 23 | none | none | |
| Elongation at Break | D-638 | % | 395 | 500 | 420 | 395 |
| 1% Secant modulus | D-638 | MPa | 390 | — | — | — |
| Shore ® Hardness D | D-2240 | — | 59 | 57 | 55 | 55 |

Various blends of hard and soft (low acid) ionomer resins may be incorporated into the cover formulations of the invention. Some examples of such blends are set forth in U.S. Pat. Nos. 4,884,814 and 5,120,791, both incorporated herein by reference. Specifically, a desirable material for use in molding the cover layer comprises a blend of a high modulus (hard) ionomer with a low modulus (soft) ionomer. A high modulus ionomer resin herein is one which measures from about 15,000 to about 70,000 psi as measured in accordance with ASTM® method D-790. The hardness may be defined as at least 50 on the Shore® D scale as measured in accordance with ASTM® method D-2240. A low modulus ionomer suitable for use herein has a flexural modulus measuring from about 1,000 to about 10,000 psi, with a hardness of about 20 to about 40 on the Shore® D scale.

The hard ionomer resins present in the blended cover formulations of the invention include ionic copolymers which are the sodium, zinc, magnesium or lithium salts of the reaction product of an olefin having 2 to 8 carbon atoms and an unsaturated monocarboxylic acid having from 3 to 8 carbon atoms. The carboxylic acid groups of the copolymer may be totally or partially (i.e., approximately 15–75 percent) neutralized. The hard ionomer resins are likely copolymers of ethylene and either acrylic and/or methacrylic acid, with copolymers of ethylene and acrylic acid being most preferred. One or more types of hard ionomeric resins may be blended into the cover formulations.

Examples of commercially available hard ionomeric resins which may be used in the cover formulation blends include, but are not limited to, the hard sodium ionic copolymer sold under the trademark "Surlyn® 8940", the hard zinc ionic copolymer sold under the trademark "Surlyn® 9910", and the hard lithium ionic copolymers sold under the trademarks "Surlyn® 7930" and "Surlyn® 7940". Surlyn® 8940 is a copolymer of ethylene with methacrylic acid with about 15 weight percent acid which is about 29% neutralized with sodium ions. This resin has an average melt flow index of about 2.8. Surlyn® 9910 is a copolymer of ethylene and methacrylic acid with about 15 weight percent acid which is about 58% neutralized with zinc ions. The average melt flow index of Surlyn® 9910 is about 0.7. Surlyn® 7930 and Surlyn® 7940 are two similar lithium neutralized poly(ethylene-methacrylic acid) ionomers differing in melt indexes. The typical properties of Surlyn® 9910, Surlyn® 8940 and Surlyn® 7940 are set forth below.

| Typical Properties of Commercially Available Hard Surlyn ® Resins Suitable for Use in the Soft/Hard Cover Blends of the Present Invention | | | | | | | | |
|---|---|---|---|---|---|---|---|---|
| | ASTM ® | 8940 | 9910 | 8920 | 8528 | 9970 | 9730 | 7940 |
| Cation Type | | Sodium | Zinc | Sodium | Sodium | Zinc | Zinc | Lithium |
| Melt flow index, gms/10 mins. | D-1238 | 2.8 | 0.7 | 0.9 | 1.3 | 14.0 | 1.6 | 3.0 |
| Specific Gravity, g/cm | D-792 | 0.95 | 0.97 | 0.95 | 0.94 | 0.95 | 0.95 | 0.93 |
| Hardness, Shore ® D | D-2240 | 66 | 64 | 66 | 60 | 62 | 63 | 64 |
| Tensile Strength (kpsi), | D-638 | (4.8) | (3.6) | (5.4) | (4.2) | (3.2) | (4.1) | (3.7) |
| MPa | | 33.1 | 24.8 | 37.2 | 29.0 | 22.0 | 28.0 | |
| Elongation, % | D-638 | 470 | 290 | 350 | 450 | 460 | 460 | 220 |
| Flexural Modulus, (kpsi) | D-790 | (51) | (48) | (55) | (32) | (28) | (30) | (61) |
| MPa | | 350 | 330 | 380 | 220 | 190 | 210 | |
| Tensile Impact (23° C.) | D-18225 | 1020 | 1020 | 865 | 1160 | 760 | 1240 | |
| $KJ/m^2$ (ft.-lbs./$in^2$) | | (485) | (485) | (410) | (550) | (360) | (590) | |
| Vicat Temperature, ° C. | D-1525 | 63 | 62 | 58 | 73 | 61 | 73 | |

Additionally, various high acid (i.e., greater than 16 weight percent acid) ionomer resins can also be incorporated into the covers of the present invention. Since the high acid ionomer resins are generally hard, they would have to be blended with soft materials to produce the soft cover hardness desired.

Examples of acrylic acid-based hard ionomer resins suitable for use in the present outer cover composition sold under "lotek®" tradename by the Exxon Corporation include, but are not limited to, lotek® 4000, lotek® 7030, lotek® 8000, lotek® 8020 and lotek® 8030. Typical properties of these and other lotek® hard ionomers suitable for use in formulating the hard/soft blends of the invention.

In addition, comparatively soft ionomers are used in formulating the hard/soft blends of the covers of the present invention. These may include methacrylic acid or acrylic acid based low modulus ionomer resins. The soft (low modulus) ionomers have a hardness from about 20 to about 40 as measured on the Shore® D scale, and a flexural modulus from about 1,000 to about 10,000 as measured in accordance with ASTM® method D-790. The soft ionomer resin is preferably a sodium or zinc salt of a terpolymer of an olefin having 2 to 8 carbon atoms, acrylic acid, and an unsaturated monomer of the acrylate ester class having from 1 to 21 carbon atoms.

Examples of methacrylic acid based soft (low-modulus) ionomer resins suitable for use in the invention include Surlyn® 8625 and Surlyn® 8629. Typical properties of these ionomers are listed below.

Typical Properties of Surlyn ® Low Modulus Ionomer Resins

| TYPICAL PROPERTIES | ASTM ®-D | AD-8265 | AD-8629 |
|---|---|---|---|
| Cation Type | | Sodium | Sodium |
| Melt Flow Index, gms/10 min. | D-1238 | 0.9 | 0.9 |
| Specific Gravity | D-792 | 0.94 | 0.94 |
| Hardness, Shore ® A/D | | 92/39 | 84/25 |
| Tensile Strength, (kpsi) MPa | D-638 | (4.2) 28.8 | (3.1) 21.2 |
| Elongation, % | D-638 | 660 | 770 |
| Flexural Modulus, (kpsi) MPa | D-790 | (7.1) 49.1 | (2.8) 19.3 |
| Tensile Impact (23° C.) KJ/m$^2$ (ft-lbs/in$^2$) | D-18225 | 494 (235) | 447 (213) |
| Melting Point, ° C. | DTA | 81 | 72 |
| Freezing Point, ° C. | DTA | 51 | 38 |
| Vicat Temperature, ° C. | D-1525 | 51 | 48 |

Certain ethylene-acrylic acid-based soft ionomer resins developed by the Exxon Corporation under the designation "lotek® 7520" may be combined with known hard ionomers (such as those indicated above) to produce soft/hard cover blends. While the exact chemical composition of the resins sold by Exxon under the designation lotek® 7520 is considered by Exxon to be confidential and proprietary information, Exxon's experimental product data sheet lists the following physical properties of the ethylene acrylic acid zinc ionomer developed by Exxon:

| Property | ASTM ® Method | Units | Typical Value |
|---|---|---|---|
| Physical Properties of Iotek ® 7520 | | | |
| Melt Index | D-1238 | g/10 min. | 2 |
| Density | D-1505 | kg/m$^3$ | 0.962 |
| Cation | | | Zinc |
| Melting Point | D-3417 | ° C. | 66 |
| Crystallization Point | D-3417 | ° C. | 49 |
| Vicat Softening Point | D-1525 | ° C. | 42 |
| Plaque Properties (2 mm thick Compression Molded Plaques) | | | |
| Tensile at Break | D-638 | MPa | 10 |
| Yield Point | D-638 | MPa | None |
| Elongation at Break | D-638 | % | 760 |
| 1% Secant Modulus | D-638 | MPa | 22 |

-continued

| Property | ASTM ® Method | Units | Typical Value |
|---|---|---|---|
| Shore ® D Hardness | D-2240 | | 32 |
| Flexural Modulus | D-790 | MPa | 26 |
| Zwick Rebond | ISO 4862 | % | 52 |
| De Mattia Flex Resistance | D-430 | Cycles | >5000 |

In addition, test data collected by the inventors indicates that lotek® 7520 resins have Shore® D hardnesses of about 32–36 (per ASTM® D-2240), melt flow indexes of 3±0.5 g/10 min (at 190° C. per ASTM® D-1288), a flexural moduluses of about 2500–3500 psi (per ASTM® D-790). Further, testing by an independent testing laboratory by pyrolysis mass spectrometry indicates that the lotek® 7520 resins are generally zinc salts of a terpolymer of ethylene, acrylic acid, and methyl acrylate.

Furthermore, it has also been found that a relatively newly developed grade of an acrylic acid based soft ionomer available from the Exxon Corporation under the designation lotek® 7510, is also effective, soft ionomer for golf ball constructions. In this regard, lotek® 7510 has the advantages (i.e. improved flow, higher C.O.R. valves at equal hardness, increased clarity, etc.) produced by the lotek® 7520 resin when compared to the methacrylic acid base soft ionomers known in the art (such as the Surlyn® 8625 and the Surlyn® 8629).

In addition, lotek® 7510, when compared to lotek® 7520, produces slightly higher C.O.R. valves at equal softness/hardness due to the lotek® 7510's higher hardness and neutralization. Similarly, lotek® 7510 produces better release properties (from the mold cavities) due to this slightly higher stiffness and lower flow rate than lotek® 7520. This is important in production where the soft covered balls tend to have lower yields caused by sticking in the molds and subsequent punched pin marks from the knock-outs.

According to Exxon, lotek® 7510 is of similar chemical composition as lotek® 7520 (i.e. a zinc salt of a terpolymer of ethylene, acrylic acid, and methyl acrylate) but is more highly neutralized. Based upon FTIR analysis, lotek® 7520 is estimated to be about 30–40 wt.-% neutralized and lotek® 7510 is estimated to be about 40–60 wt.-% neutralized. The typical properties of lotek® 7510 in comparison of those of lotek® 7520 are set forth below:

Physical Properties of Iotek ® 7510 in Comparison to Iotek 7520

| | IOTEK ® 7520 | IOTEK ® 7510 |
|---|---|---|
| MI, G/10 MIN | 2.0 | 0.8 |
| Density | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, psi | 1450 | 1750 |
| Elongation, % | 760 | 690 |
| Hardness, Shore ® D | 32 | 35 |

The cover formulations include various blends of ionomeric resins which form a soft cover having a Shore® D hardness of 63 or less.

Additional examples of an outer cover layer for use in forming the golf ball of the present invention incorporates high molecular weight ionomer resins, such as EX 1005, 1006, 1007, 1008 and 1009, provided by Exxon Chem. Co., or any combination thereof, as shown in Table 7. However, they have a high tensile modulus/hardness ratio that must be blended with softer ionomers and/or other soft resins to produce the soft cover material of the present invention.

TABLE 7

Examples of Exxon High Molecular Weight Ionomers

| PROPERTY | Ex 1006 | Ex 1006 | Ex 1007 | Ex 1008 | Ex 1009 | 7310 |
|---|---|---|---|---|---|---|
| Melt Index, g/10 min. | 0.7 | 1.3 | 1.0 | 1.4 | 0.8 | 1.0 |
| Cation | Na | Na | Zn | Zn | Na | Zn |
| Melting Point, ° C. | 85.3 | 86 | 85.8 | 86 | 91.3 | 91 |
| Vicat Softening Point, ° C. | 54 | 57 | 60.5 | 60 | 56 | 69 |
| Tensile @ Break, MPa | 33.9 | 33.5 | 24.1 | 23.6 | 32.4 | 24 |
| Elongation @ Break, % | 403 | 421 | 472 | 427 | 473 | 520 |
| Hardness, Shore ® D | 58 | 58 | 51 | 50 | 56 | 52 |
| Flexural Modulus, MPa | 289 | 290 | 152 | 141 | 282 | 150 |

Appropriate fillers or additive materials may also be added to produce the cover compositions of the present invention. These additive materials include dyes (for example, Ultramarine Blue® sold by Whitaker, Clark and Daniels of South Plainfield, N.J.), and pigments, i.e., white pigments such as titanium dioxide (for example UNITANE® 0-110 commercially available from Kemira, Savannah, Ga.) zinc oxide, and zinc sulfate, as well as fluorescent pigments. As indicated in U.S. Pat. No. 4,884,814, the amount of pigment and/or dye used in conjunction with the polymeric cover composition depends on the particular base ionomer mixture utilized and the particular pigment and/or dye utilized. The concentration of the pigment in the polymeric cover composition can be from about 1% to about 10% as based on the weight of the base ionomer mixture. A more preferred range is from about 1% to about 5% as based on the weight of the base ionomer mixture. The most preferred range is from about 1% to about 3% as based on weight of the base ionomer mixture. The most preferred pigment for use in accordance with this invention is titanium dioxide (Anatase).

Moreover, since there are various hues of white, i.e. blue white, yellow white, etc., trace amounts of blue pigment may be added to the cover stock composition to impart a blue white appearance thereto. However, if different hues of the color white are desired, different pigments can be added to the cover composition at the amounts necessary to produce the color desired.

In addition, it is within the purview of this invention to add to the cover compositions of this invention compatible materials which do not affect the basic novel characteristics of the composition of this invention. Among such materials are antioxidants (i.e. Santonox® R), commercially available from Flexysys, Akron, Ohio, antistatic agents, stabilizers, compatablizers and processing aids. The cover compositions of the present invention may also contain softening agents, such as plasticizers, etc., and reinforcing materials, as long as the desired properties produced by the golf ball covers of the invention are not impaired.

Furthermore, optical brighteners, such as those disclosed in U.S. Pat. No. 4,679,795 may also be included in the cover composition of the invention. Examples of suitable optical brighteners which can be used in accordance with this invention are Uvitex® OB as sold by the Ciba-Geigy Chemical Company, Ardsley, N.Y. Uvitex® OB is believed to be 2,5-Bis(5-tert-butyl-2-benzoxazoyl)-thiophene. Examples of other optical brighteners suitable for use in accordance with this invention are as follows: Leucopure® EGM as sold by Sandoz, East Hanover, N.J. 07936. Phorwhite® K-20G2 is sold by Mobay Chemical Corporation, P.O. Box 385, Union Metro Park, Union, N.J. 07083, and is thought to be a pyrazoline derivative. Eastobrite® OB-1 as sold by Eastman Chemical Products, Inc., Kingsport, Tenn. is thought to be 4,4-Bis(-benzoxaczoyl)stilbene. The above-mentioned UVITEX® and EASTOBRITE® OB-1 are preferred optical brighteners for use in accordance with this invention. Moreover, since many optical brighteners are colored, the percentage of optical brighteners utilized must not be excessive in order to prevent the optical brightener from functioning as a pigment or dye in its own right.

The percentage of optical brighteners which can be used in accordance with this invention is from about 0.01% to about 0.5% as based on the weight of the polymer used as a cover stock. A more preferred range is from about 0.05% to about 0.25% with the most preferred range from about 0.10% to about 0.20% depending on the optical properties of the particular optical brightener used and the polymeric environment in which it is a part.

Generally, the additives are admixed with an ionomer to be used in the cover composition to provide a masterbatch (abbreviated herein as MB) of desired concentration and an amount of the masterbatch sufficient to provide the desired amounts of additive is then admixed with the copolymer blends.

The composition of the cover may vary depending upon the desired properties for the resulting golf ball. A wide array of cover formulations may be utilized such as those disclosed in U.S. Pat. Nos. 4,986,545; 5,098,105; 5,120,791; 5,187,013; 5,306,760; 5,312,857; 5,324,783; 5,328,959; 5,330,837; 5,338,610; 5,542,677; 5,580,057; 5,591,803; and 5,733,206, all of which are hereby incorporated by reference.

The covered golf ball can be formed in any one of several methods known in the art. For example, the molded core may be placed in the center of a golf ball mold and the ionomeric resin-containing cover composition injected into and retained in the space for a period of time at a mold temperature of from about 40° F. to about 120° F.

Alternatively, the cover composition may be injection molded at about 300° F. to about 450° F. into smooth-surfaced hemispherical shells, a core and two such shells placed in a dimpled golf ball mold and unified at temperatures on the order of from about 200° F. to about 300° F.

The golf ball produced is then painted and marked, painting being effected by spraying techniques.

DEFINITIONS

The following is a series of definitions used in the specification and claims.

PGA® Compression

PGA® compression is an important property involved in the performance of a golf ball. The compression of the ball can affect the playability of the ball on striking and the sound or "click" produced. Similarly, compression can effect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates.

The term "compression" utilized in the golf ball trade generally defines the overall deflection that a golf ball undergoes when subjected to a compressive load. For example, PGA® compression indicates the amount of change in golf ball's shape upon striking. The development of solid core technology in two-piece balls has allowed for much more precise control of compression in comparison to thread wound three-piece balls. This is because in the manufacture of solid core balls, the amount of deflection or deformation is precisely controlled by the chemical formula used in making the cores. This differs from wound three-piece balls wherein compression is controlled in part by the winding process of the elastic thread. Thus, two-piece and multi-layer solid core balls exhibit much more consistent compression readings than balls having wound cores such as the thread wound three-piece balls.

In the past, PGA® compression related to a scale of from 0 to 200 given to a golf ball. The lower the PGA® compression value, the softer the feel of the ball upon striking. In practice, tournament quality balls have compression ratings around 70–110, preferably around 80 to 100.

In determining PGA® compression using the 0–200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA® compression value of 100 (i.e., 200–100) and a ball which deflects 0.110 inches (110×0.001 inches) has a PGA® compression of 90 (i.e., 200–110).

In order to assist in the determination of compression, several devices have been employed by the industry. For example, PGA® compression is determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA® compression can be shown by utilizing a golf ball compression tester produced by Atti Engineering Corporation of Newark, N.J. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that it measures the upward movement of the spring-loaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicant also utilizes a modified Riehle® Compression Machine originally produced by Riehle® Bros. Testing Machine Company, Phil., Pa. to evaluate compression of the various components (i.e., cores, mantle cover balls, finished balls, etc.) of the golf balls. The Riehle® compression device determines deformation in thousandths of an inch under a load designed to emulate the 200 pound spring constant of the Atti or PGA® compression device. Using such a device, a Riehle® compression of 61 corresponds to a deflection under load of 0.061 inches.

Additionally, an approximate relationship between Riehle® compression and PGA® compression exists for balls of the same size. It has been determined by Applicant that Riehle® compression corresponds to PGA® compression by the general formula PGA® compression=160-Riehle® compression. Consequently, 80 Riehle® compression corresponds to 80 PGA® compression, 70 Riehle® compression corresponds to 90 PGA® compression, and 60 Riehle® compression corresponds to 100 PGA® compression. For reporting purposes, Applicant's compression values are usually measured as Riehle® compression and converted to PGA® compression.

Furthermore, additional compression devices may also be utilized to monitor golf ball compression so long as the correlation to PGA® compression is know. These devices have been designed, such as a Whitney Tester, to correlate or correspond to PGA® compression through a set relationship or formula.

Coefficient of Restitution

As briefly defined above, the resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the coefficient of restitution (COR) and the surface configuration (dimple pattern, ratio of land area to dimple area, etc.) of the ball.

The COR in solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125 ±/−5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them. The screens were separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

Shore® D Hardness

As used herein, "Shore® D hardness" of a cover layer is measured generally in accordance with ASTM® D-2240, except the measurements are made on the curved surface of a molded cover layer, rather than on a plaque. Furthermore, the Shore® D hardness of the cover layer is measured while the cover layer remains over the core and any underlying cover layers. When a hardness measurement is made on a dimpled cover, Shore® D hardness is measured, to the best extent possible, at a land area of the dimpled cover.

Irradiation Treatment

Golf balls according to the invention preferably have a low post-irradiation PGA® compression. It has been found that excellent results are obtained when the post-irradiation PGA® compression of the golf balls is an increase in PGA® compression of at least 5% as compared to the PGA® compression of the ball prior to treatment. The Shore® D hardness of the golf balls of the invention after irradiation is in the range of 40–60. Particularly good results are obtained when the Shore® D hardness of the golf balls is in the range of 45–55, and most preferably about 50.

One embodiment of a method for electron beam treating golf balls according to the invention can be described as follows. The golf ball is placed on a channel along which it slowly moves. Electrons from electron beam lamps contact the surface of the ball. The lamps are positioned to provide a generally uniform dose of radiation on the entire surface of the ball as the ball rolls along the channel. Preferably, the balls are irradiated with an electron beam dosage set forth above.

Cover Durability

The golf balls of the invention are found to exhibit a post-treatment scuff resistance in the range of 1–3 on a scale of 1–4. It is preferred that the treatment be appropriate to provide the golf balls with a scuff resistance of 1–2.5, and more preferably 1–2. Golf balls according to the invention have a cut resistance in the range of 1–3 on a scale of 1–5. It is preferred that the golf balls of the invention have a cut resistance of 1–2.5 and most preferably 1–2.

The scuff resistance test was conducted in the following manner: a Top-Flite Tour pitching wedge (1994) with box grooves was obtained and was mounted in a Miyamae driving machine. The club face was oriented for a square hit. The forward/backward tee position was adjusted so that the tee was four inches behind the point in the downswing where the club was vertical. The height of the tee and the toe-heel position of the club relative to the tee were adjusted in order that the center of the impact mark was about ¾ of an inch above the sole and was centered toe to heel across the face. The machine was operated at a clubhead speed of 125 feet per second. Three samples of each ball were tested. Each ball was hit three times. After testing, the balls were rated according to the following table:

| Rating | Type of Damage |
|---|---|
| 1 | Little or no damage (groove markings or dents) |
| 2 | Small cuts and/or ripples in cover |
| 3 | Moderate amount of material lifted from ball surface but still attached to ball |
| 4 | Material removed or barely attached |

Cut resistance was measured in accordance with the following procedure: A golf ball was fired at 135 feet per second against the leading edge of a 1994 Top-Flite Tour pitching wedge, wherein the leading edge radius is 1/32 inch, the loft angle is 51 degrees, the sole radius is 2.5 inches, and the bounce angle is 7 degrees.

The cut resistance of the balls tested herein was evaluated on a scale of 1–5. A 5 represents a cut that extends completely through the cover to the core; a 4 represents a cut that does not extend completely through the cover but that does break the surface; a 3 does not break the surface of the cover but does leave a permanent dent; a 2 leaves only a slight crease which is permanent but not as severe as 3; and a 1 represents virtually no visible indentation or damage of any sort.

It has been found that golf balls which are treated according to the irradiation technique of the present invention exhibit a particular improvement in scuff and/or cut resistance. This improvement is particularly significant when the golf balls are struck with a square-grooved iron. It is has been found that square-grooved irons and other sharp-grooved irons tend to abrade and damage golf ball covers more readily than irons having "V-type" grooves.

Fillers

Fillers preferably are used to adjust the density, flex modulus, mold release, and/or melt flow index of the core and/or cover layer. More preferably, at least when the filler is for adjustment of density or flex modulus of the cover, it is present in an amount of at least five parts by weight based upon 100 parts by weight of the resin composition. With some fillers, up to about 200 parts by weight can be used.

A density adjusting filler according to the invention preferably is a filler which has a specific gravity which is at least 0.05 and more preferably at least 0.1 higher or lower than the specific gravity of the resin composition. Particularly preferred density adjusting fillers have specific gravities which are higher than the specific gravity of the resin composition by 0.2 or more, even more preferably by 2.0 or more. A flex modulus adjusting filler according to the invention is a filler which, when used in an amount of e.g. 1–100 parts by weight based upon 100 parts by weight of resin composition, will raise or lower the flex modulus (ASTM® D-790) of the resin composition by at least 1% and preferably at least 5% as compared to the flex modulus of the resin composition without the inclusion of the flex modulus adjusting filler.

A mold release adjusting filler is a filler which allows for easier removal of part from mold, and eliminates or reduces the need for external release agents which otherwise could be applied to the mold. A mold release adjusting filler typically is used in an amount of up to about 2 wt % based upon the total weight of the cover layer. A melt flow index adjusting filler is a filler which increases or decreases the melt flow, or ease of processing of the composition.

A density adjusting filler is used to control the moment of inertia, and thus the initial spin rate of the ball and spin decay. The additional a filler with a lower specific gravity than the resin composition results in a decrease in moment of inertia and a higher initial spin rate than would result if no filler were used. The addition of a filler with a higher specific gravity than the resin composition results in an increase in moment of inertia and a lower initial spin rate. High specific gravity fillers are preferred as less volume is used to achieve the desired cover total weight. Nonreinforcing fillers are also preferred as they have minimal effect on COR. Preferably, the filler does not chemically react with the resin composition to a substantial degree, although some reaction may occur when, for example, zinc oxide is used in a cover layer which contains some ionomer.

With respect to the cover composition, the density-increasing fillers for use in the invention preferably have a specific gravity in the range of 1.0–20. The density-reducing fillers for use in the invention preferably have a specific gravity of 0.06–1.4, and more preferably 0.06–0.90. The flex modulus increasing fillers have a reinforcing or stiffening effect due to their morphology, their interaction with the resin, or their inherent physical properties. The flex modulus reducing fillers have an opposite effect due to their relatively flexible properties compared to the matrix resin. The melt flow index increasing fillers have a flow enhancing effect due to their relatively high melt flow versus the matrix. The melt flow index decreasing fillers have an opposite effect due to their relatively low melt flow index versus the matrix.

Fillers may be or are typically in a finely divided form, for example, in a size generally less than about 20 mesh, preferably less than about 100 mesh U.S. standard size, except for fibers and flock, which are generally elongated. Flock and fiber sizes should be small enough to facilitate processing. Filler particle size will depend upon desired effect, cost, ease of addition, and dusting considerations. The filler preferably is selected from the group consisting of precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, tungsten carbide, metal oxides, metal stearates, particulate carbonaceous materials, micro balloons, and combinations thereof. Non-limiting examples of suitable fillers, their densities, and their preferred uses are as follows:

| Filler Type | Spec. Grav | Comments |
|---|---|---|
| Precipitated hydrated silica | 2.0 | 1, 2 |
| Clay | 2.62 | 1, 2 |
| Talc | 2.85 | 1, 2 |
| Asbestos | 2.5 | 1, 2 |
| Glass fibers | 2.55 | 1, 2 |
| Aramid fibers (KEVLAR ®) | 1.441 | 1, 2 |
| Mica | 2.8 | 1, 2 |
| Calcium metasillicate | 2.9 | 1, 2 |
| Barium sulfate | 4.6 | 1, 2 |
| Zinc sulfide | 4.1 | 1, 2 |
| Lithopone | 4.2–4.3 | 1, 2 |
| Silicates | 2.1 | 1, 2 |
| Silicon carbide platelets | 3.18 | 1, 2 |
| Silicon carbide whiskers | 3.2 | 1, 2 |
| Tungsten carbide | 15.6 | 1 |
| Diatomaceous earth | 2.3 | 1, 2 |
| Polyvinyl chloride | 1.41 | 1, 2 |
| Carbonates | | |
| Calcium carbonate | 2.71 | 1, 2 |
| Magnesium carbonate | 2.20 | 1, 2 |
| Metals and Alloys (powders) | | |
| Titanium | 4.51 | 1 |
| Tungsten | 19.35 | 1 |
| Aluminum | 2.70 | 1 |
| Bismuth | 9.78 | 1 |
| Nickel | 8.90 | 1 |
| Molybdenum | 10.2 | 1 |
| Iron | 7.86 | 1 |
| Steel | 7.8–7.9 | 1 |
| Lead | 11.4 | 1, 2 |
| Copper | 8.94 | 1 |
| Brass | 8.2–8.4 | 1 |
| Boron | 2.34 | 1 |
| Boron carbide whiskers | 2.52 | 1, 2 |
| Bronze | 8.70–8.74 | 1 |
| Cobalt | 8.92 | 1 |
| Berylliuim | 1.84 | 1 |
| Zinc | 7.14 | 1 |
| Tin | 7.31 | 1 |

-continued

| Filler Type | Spec. Grav | Comments |
|---|---|---|
| Metal Oxides | | |
| Zinc oxide | 5.57 | 1, 2 |
| Iron oxide | 5.1 | 1, 2 |
| Aluminum oxide | 4.0 | |
| Titanium oxide | 3.9–4.1 | 1, 2 |
| Magnesium oxide | 3.3–3.5 | 1, 2 |
| Zirconium oxide | 5.73 | 1, 2 |
| Metal Stearates | | |
| Zinc stearate | 1.09 | 3, 4 |
| Calcium stearate | 1.03 | 3, 4 |
| Barium stearate | 1.23 | 3, 4 |
| Lithium stearate | 1.01 | 3, 4 |
| Magnesium stearate | 1.03 | 3, 4 |
| Particulate carbonaceous materials | | |
| Graphite | 1.5–1.8 | 1, 2 |
| Carbon black | 1.8 | 1, 2 |
| Natural bitumen | 1.2–1.4 | 1, 2 |
| Cotton flock | 1.3–1.4 | 1, 2 |
| Cellulose flock | 1.15–1.5 | 1, 2 |
| Leather fiber | 1.2–1.4 | 1, 2 |
| Micro balloons | | |
| Glass | 0.15–1.1 | 1, 2 |
| Cermaic | 0.2–0.7 | 1, 2 |
| Fly ash | 0.6–0.8 | 1, 2 |
| Coupling Agents Adhesion Promoters | | |
| Titanates | 0.95–1.17 | |
| Zirconates | 0.95–1.11 | |
| Silane | 0.95–1.2 | |

1 Particularly useful for adjusting density of the covers and cores.
2 Particularly useful for adjusting flex modulus of the cover layer.
3 Particularly useful for adjusting mold release of the cover layer.
4 Particularly useful for increasing melt flow index of the cover layer.
All fillers except for metal stearates would be expected to reduce the melt flow index of the cover layer.

The amount of filler employed is primarily a function of weight requirements, properties desired and distribution.

Ionomeric Resins

Ionomeric resins include copolymers formed from the reaction of an olefin having 2 to 8 carbon atoms and an acid which includes at least one member selected from the group consisting of alpha, beta-ethylenically unsaturated mono- or dicarboxylic acids with a portion of the acid groups being neutralized with cations. Terpolymer ionomers further include an unsaturated monomer of the acrylate ester class having from 1 to 21 carbon atoms. The olefin preferably is an alpha olefin and more preferably is ethylene. The acid preferably is acrylic acid or methacrylic acid. The ionomers typically have a degree of neutralization of the acid groups in the range of about 10–100%.

The present invention is further illustrated by the following examples in which the parts of the specific ingredients are by weight. It is to be understood that the present invention is not limited to the examples, and various changes and modifications may be made in the invention without departing from the spirit and scope thereof.

EXAMPLE 1

Comparative Cores and Properties

Using the ingredients tabled below, comparative golf ball cores having a finished diameter of about 1.470 to about 1.475 inches were produced by compression molding and subsequent removal of a surface layer by grinding. Each core was formulated using 100 parts elastomer (rubber). In the formulations, the amounts of remaining ingredients are expressed in parts by weight, and the coefficient of restitution and compression achieved are set forth below.

The Tables below summarize the results of testing of four core compositions.

| | 1 Control | Trial 2 | 3 | 4 |
|---|---|---|---|---|
| | Composition of Golf Ball Cores | | | |
| Component | | | | |
| Cariflex ® BR-1220 | 100 | — | — | — |
| Cariflex ® BCP-820 | — | 100 | 40 | 40 |
| Neo Cis 60 | — | — | 60 | — |
| CB-22 | — | — | — | 60 |
| Zinc Oxide (activator filler) | 30.9 | 31 | 30.7 | 30.2 |
| Zinc Stearate (activator) | 16 | 16 | 16 | 16 |
| ZDA (zinc diacrylate) | 21.1 | 20.9 | 21.5 | 22.5 |
| 231 XL (peroxide) | 0.90 | 0.90 | 0.90 | 0.90 |
| | 168.9 | 168.8 | 169.1 | 169.6 |
| | Properties of Golf Ball Cores | | | |
| Property | | | | |
| Size (pole dia. inches) | 1.474 | 1.474 | 1.473 | 1.475 |
| Weight (grams) | 33.3 | 33.3 | 33.2 | 33.3 |
| Riehle ® Compression | 0.112 | 0.109 | 0.112 | 0.113 |
| C.O.R. | 0.776 | 0.785 | 0.781 | 0.781 |
| Nes Factor[1] | .888 | .894(+6) | .893(+5) | .894(+6) |

[1]Nes Factor is the sum of the C.O.R. and the Riehle ® compression. The higher the number the higher the resilience. This adjusts the results for compression, i.e. Trial #2 has a compression of 0.109, this is 3 points harder than the control and is 9 points faster in C.O.R. than the control.This is a net gain of 6 points. Trial #3 has exactly the same compression as the control and needs no Nes Factor correction as both the C.O.R. and Nes Factor are 5 points higher.

The results above show that the high Mooney BCP-820 is 9 points higher in C.O.R. vs. the control (low Mooney BR-1220). Blends of the high Mooney BCP-820 with Neodymium catalyzed Neo Cis 60 and CB-22 also show a 5 to 6 point gain in C.O.R.

The high Mooney BCP-820, while giving high C.O.R. values, is extremely difficult to process using conventional equipment. Blending the high Mooney BCP-820 with Neodymium catalyzed polybutadiene rubber solves the processing problems but maintains the high C.O.R. values.

The Tables below summarize the results of additional testing.

| | Trial | | | | | |
|---|---|---|---|---|---|---|
| | 1 | 2 | 3 | 4 | 5 | 6 |
| Composition of Golf Ball Cores | | | | | | |
| Component | | | | | | |
| Cariflex ® BCP-B20 | 100 | — | — | 40 | 40 | 20 |
| Neo Cis 40 | — | 100 | — | 60 | — | — |
| Neo Cis 60 | — | — | 100 | — | 60 | 80 |
| Zinc Oxide | 31 | 31 | 31 | 31 | 31 | 31 |
| Zinc Stearate | 16 | 16 | 16 | 16 | 16 | 16 |
| ZDA | 20.9 | 20.9 | 20.9 | 20.9 | 20.9 | 20.9 |
| 231 XL | 0.90 | 0.90 | 0.90 | 0.90 | 0.90 | 0.90 |
| | 168.8 | 168.8 | 168.8 | 168.8 | 168.8 | 168.8 |
| Properties of Golf Ball Cores | | | | | | |
| Property | | | | | | |
| Size (pole dia. inches) | 1.476 | 1.475 | 1.476 | 1.476 | 1.476 | 1.476 |
| Weight (grams) | 33.4 | 33.3 | 33.4 | 33.4 | 33.4 | 33.3 |
| Riehle ® Compression | 0.107 | 0.119 | 0.116 | 0.115 | 0.112 | 0.114 |
| C.O.R. | 0.785 | 0.773 | 0.777 | 0.776 | 0.780 | 0.778 |
| Nes Factor | .892 | .892 | .893 | .891 | .892 | .892 |

The results above show there is very little difference in the 6 trials when the C.O.R. is corrected for differences in compression, i.e. Nes Factor. The Neodymium rubber when used at 100% or when blended with high Mooney BCP-820 is equal to the properties of the high Mooney BCP-820 when used at 100%. Neodymium rubber when used at 100% is also extremely difficult to process due to high die swell during extrusion of preforms and high cold flow of the rubber causing deformed preforms resulting in very high rejects. Neodymium polybutadiene and high Mooney polybutadiene rubber such as BCP-820 cannot be processed when used alone at 100 parts or conventional equipment such as two roll mills and extruders.

When the two rubbers above are blended together, processing of the synergistic mixture becomes easy and practical without losing any performance or C.O.R.

The Tables below summarize the results of testing of four additional core compositions.

| Composition of Golf Ball Cores | | | | |
|---|---|---|---|---|
| | Trial | | | |
| Component | 1 | 2 | 3 | 4 |
| Cariflex ® BR-1220[1] | 70 | 100 | — | — |
| Taktene ® 220[2] | 30 | — | — | 30 |
| Shell BCP 820[3] | — | — | 100 | 70 |
| ZnO (activator filler) | 31.5 | 31.5 | 31.5 | 31.5 |
| Regrind (ground flash) | 16 | 16 | 16 | 16 |
| Zn Stearate (activator) | 16 | 16 | 16 | 16 |
| ZDA (zinc diacrylate) | 21.5 | 21.5 | 21.5 | 21.5 |
| 231 XL (peroxide) | 0.90 | 0.90 | 0.90 | 0.90 |
| Total | 185.9 | 185.9 | 185.9 | 185.9 |

-continued

| Properties of Golf Ball Cores | | | | |
|---|---|---|---|---|
| | Trial | | | |
| Property | 1 Control | 2 | 3 | 4 |
| Size (dia. inches) | 1.493 | 1.492 | 1.492 | 1.492 |
| Weight (grams) | 34.4 | 34.4 | 34.5 | 34.4 |
| Riehle ® Compression | .099 | .095 | .093 | .096 |
| C.O.R. | 0.778 | 0.781 | 0.787 | 0.782 |
| Durability | Pass | Pass | Pass | Pass |
| Nes Factor | .877 | .876 | .880 | .878 |

The following Tables summarize the results of testing of additional core compositions.

| Composition of Golf Ball Cores | | |
|---|---|---|
| | Trial | |
| Component | 1 Control | 2 |
| Cariflex ® BR-1220 | 70 | — |
| Taktene ® 220 | 30 | — |
| Shell BCP-820 | — | 100 |
| ZnO | 31.5 | 32.0 |
| Regrind | 16 | 16 |
| Zn Stearate | 16 | 16 |
| ZDA | 21.5 | 20.5 |
| 231XL | 0.90 | 0.90 |
| Total | 185.9 | 185.4 |
| Properties of Golf Ball Cores | | |
| | Trial | |
| Property | 1 Control | 2 |
| Size (dia. inches) | 1.542 | 1.543 |
| Weight (grams) | 37.8 | 38.0 |
| Riehle Compression | .093 | .093 |
| C.O.R. | 0.775 | 0.782 |
| Nes factor | .868 | .875 |

The above results demonstrate that when the Zinc Diacrylate (ZDA) level is adjusted to obtain the same Riehle® compression as the Control, the C.O.R. increased 7 points higher for the BCP-820 and the Nes Factor was also 7 points higher.

The Tables below summarize the results of additional testing of core compositions.

| Composition of Golf Ball Cores | | | |
|---|---|---|---|
| | Trial | | |
| Component | 1 Control | 2 | 3 |
| Cariflex ® BR-1220 | 70 | 100 | — |
| Taktene ® 220 | 30 | — | — |
| Shell BCP-820 | — | — | 100 |
| ZnO | 31.5 | 31.7 | 31.8 |
| Regrind | 16 | 16 | 16 |
| Zn Stearate | 16 | 16 | 16 |
| ZDA | 21.5 | 21.1 | 19.9 |
| 231 XL | 0.90 | 0.90 | 0.90 |
| Total | 185.9 | 185.7 | 184.6 |

-continued

| Properties of Golf Ball Cores | | | |
|---|---|---|---|
| Property | 1 Control | Trial 2 | 3 |
| Size (dia. inches) | 1.493 | 1.493 | 1.494 |
| Weight (grams) | 34.5 | 34.4 | 34.3 |
| Riehle ® Compression | .098 | .104 | .106 |
| C.O.R. | 0.777 | 0.773 | 0.776 |
| Nes Factor | .875 | .877 | .882 |

The above data demonstrate that, despite adjusting the ZDA level, the Riehle® compressions were different. However, the Nes Factor shows that Trial #3 using 100% BCP-820 is 7 points higher than the Control.

It is evident from the proceeding tables that the high Mooney cobalt catalyzed polybutadiene BCP-820 produces a higher C.O.R. (3–7 points) vs. the low Mooney cobalt catalyzed polybutadiene. Blending with the low Mooney polybutadiene produces less of a gain in C.O.R.

EXAMPLE 2

Manufacture of Comparative Golf Balls

A number of competitive golf ball cores were made having the following formulation and characteristics as shown below.

| Material | Weight |
|---|---|
| High Cis Polybutadiene Cariflex ® BR-1220[1] | 70 |
| High Cis polybutadiene Taktene ® 220[2] | 30 |
| Zinc Oxide[3] | 25 |
| Core Regrind[4] | 20 |
| Zinc Stearate[5] | 15 |
| Zinc Diacrylate[6] | 18 |
| Red Colorant | .14 |
| Peroxide (Luperco ® 23/XL or Triganox 29/40)[7] | .90 |

[1]Muehlstein, Nowalk, CT
[2]Bayer Corp., Akron, OH
[3]Zinc Corp of America, Monaca, PA
[4]golf ball core regrind (internal source)
[5]Synpro, Cleveland, OH
[6]Rockland React Rite, Rockland, GA
[7]R.T. Vanderbilt, Norwalk, CT The cores had a diameter of 1.560 inches, a PGA® compression of about 40 and a COR of about 0.775. To make the cores, the core ingredients were intimately mixed in an internal mixer until the compositions were uniform, usually over a period of from about 5 to about 20 minutes. The sequence of addition of the components was not found to be critical. As a result of shear during mixing, the temperature of the core mixtures rose to about 190° F. whereupon the batch was discharged onto a two roll mill, mixed for about one minute and sheeted out.

The sheet was rolled into a "pig" and then placed in a Barwell™ preformer and slugs produced. The slugs were then subjected to compression molding at about 310° F. for about 11½ minutes. After molding, the cores were cooled under ambient conditions for about 4 hours. The molded cores were then subjected to a centerless grinding operation whereby a thin layer of the molded core was removed to produce a round core having a diameter of 1.2 to 1.5 inches. Upon completion, the cores were measured for size and in some instances weighed and tested to determine compression and COR.

The cores were covered with an injection-molded cover blend of 35 parts by weight EX® 1006 (Exxon Chemical Corp., Houston, Tex.), 55.6 parts by weight EX 1007 (Exxon Chemical Corp., Houston, Tex.) and 9.4 parts by weight of Masterbatch. The Masterbatch contained 100 parts by weight lotek® 7030, 31.72 parts by weight titanium dioxide (Unitane® 0-110), 0.6 parts by weight pigment (Ultramarine Blue®), 0.35 parts by weight optical brightener (Eastobrite® OB1) and 0.05 parts by weight stabilizer (Santanox R).

The cover had a Shore® D hardness of 67. The balls had a PGA® compression of 65 and a COR of 0.795.

EXAMPLE 3

Production and Testing of Cores of the Invention with Hard Covers

In yet another series of trials, a series of soft cores and various hard covers were formed to produce golf balls. These cover and core compositions are set forth below.

| Cover Compositions | | | | | |
|---|---|---|---|---|---|
| Materials | 39A (wt %) | 39B (wt %) | 39C (wr %) | 39D (wt %) | 39E (wt %) |
| Iotek ® 1006 | — | 43.75 | — | — | 43.75 |
| Iotek ® 1007 | — | 43.75 | — | — | — |
| Surlyn ® 8940 | 21 | — | — | — | — |
| Surlyn ® 9910 | 52.8 | — | — | — | — |
| Surlyn ® 8120 | 4 | — | — | — | — |
| Surlyn ® 8320 | 9.7 | — | — | — | — |
| Surlyn ® 8140 | — | — | 35 | — | — |
| Surlyn ® 6120 | — | — | 52.5 | 87.5 | 43.75 |
| White MB | 12.5 | 12.5 | 12.5 | 12.5 | 12.5 |

| Core Formulations | | | |
|---|---|---|---|
| Materials | 37A (pph) | 37B (pph) | 37C (pph) |
| BCP-820 | 45 | 45 | 45 |
| Neo Cis 40 | 55 | 55 | 55 |
| Zinc Oxide | 29.5 | 23.9 | 23.2 |
| Zinc Stearate | 16 | 16 | 16 |
| Zinc Diacrylate (ZDA) | 18.4 | 20.4 | 21.9 |
| Lavender MB | — | 0.14 | — |
| Blue MB | | | |
| Yellow MB | 0.14 | | 0.14 |
| Triganox 42-40B | 1.25 | 1.25 | 1.25 |

Golf balls were produced using various combinations of these cover and core compositions. A summary of these balls is set forth below. The noted barrel test is utilized to determine an indication of durability. This test is described in detail in U.S. Pat. Nos. 5,827,134 and 5,820,489 herein incorporated by reference. Basically, the test involves the use of an air cannon that fires a golf ball at about 135 ft/second into a five-sided steel drum until the ball breaks. One dozen of each ball type is tested. The average is the average number of runs until the ball breaks. Higher averages indicate greater durability.

| Sample | 1<br>37A | 2<br>37A | 3<br>37A | 4<br>37B | 5<br>37B | 6<br>37B | 7<br>37B | 8<br>37B | 9<br>37C | 10<br>37C | 11<br>37C |
|---|---|---|---|---|---|---|---|---|---|---|---|
| CORE | | | | | | | | | | | |
| Size | 1.500" | 1.500" | 1.500" | 1.560" | 1.560" | 1.560" | 1.560" | 1.560" | 1.560" | 1.560" | 1.560" |
| Weight | 34.3 | 34.3 | 34.3 | 37.8 | 37.8 | 37.8 | 37.8 | 37.8 | 37.8 | 37.8 | 37.8 |
| Comp | 134 | 134 | 134 | 116 | 116 | 116 | 116 | 116 | 106 | 106 | 106 |
| COR | 766 | 766 | 765 | 781 | 781 | 781 | 781 | 781 | 786 | 786 | 786 |
| COVER | | | | | | | | | | | |
| 39A | | | | x | | | | | | | |
| 39B | x | | | | x | | | | x | | |
| 39C | | x | | | | x | | | | x | |
| 39D | | | x | | | | x | | | | x |
| 39E | | | | | | | | x | | | |
| FINISHED | | | | | | | | | | | |
| Cover Thickness | 0.090" | 0.090" | 0.09" | 0.060" | 0.060" | 0.060" | 0.060" | 0.060" | 0.060" | 0.060" | 0.060" |
| Size | 1.68 | 1.681 | 1.682 | 1.683 | 1.683 | 1.684 | 1.685 | 1.683 | 1.683 | 1.684 | 1.685 |
| Weight | 45.3 | 45.3 | 45.3 | 45.5 | 45.4 | 45.5 | 45.5 | 45.4 | 45.4 | 45.5 | 45.5 |
| Riehle ® Comp | 90 | 82 | 87 | 97 | 94 | 89 | 91 | 91 | 88 | 83 | 85 |
| COR | 809 | 815 | 807 | 803 | 812 | 816 | 812 | 814 | 814 | 818 | 814 |
| Shore D | 67 | 70–71 | 69–70 | 65 | 67 | 70–71 | 69–70 | 69 | 67 | 70–71 | 69–70 |
| Cold Crack | Pass | Pass | Pass | Pass | Pass | Pass | Pass | Pass | Pass | Pass | Pass |
| Barrel (1 dozen) Durability | | | | | | | | | | | |
| Avg | 309 | 283 | 325 | 312 | 285 | 269 | 315 | 308 | 348 | 306 | 375 |
| Min | 256 | 206 | 256 | 272 | 225 | 206 | 194 | 239 | 256 | 225 | 281 |
| max | 500 | 332 | 380 | 380 | 344 | 306 | 541 | 380 | 500 | 352 | 570 |
| # above 300 | 7 | 3 (of 13) | 10 | 7 | 3 | 1 (of 11) | 5 | 6 | 10 | 7 | 11 |

All core formulations are in general accordance with the present invention in composition. All of the balls utilized a hard cover. This reduced spin although resulted in superior COR.

In another set of trials, a series of particularly preferred cores and hard covers were formed to produce the following golf balls.

| Materials | Cover A (wt %) | Cover B (wt %) | Cover C (wt %) |
|---|---|---|---|
| Iotek ® 1006 | — | 35 | — |
| Iotek ® 1007 | — | 52.5 | — |
| Surlyn ® 8140 | 35 | — | — |
| Surlyn ® 6120/8552 | 52.5 | — | — |
| Surlyn ® 9910 | — | — | 54.6 |
| Surlyn ® 8940 | — | — | 22 |
| Surlyn ® 8120 | — | — | 4 |
| Surlyn ® 8320 | — | — | 10 |
| White MB | 12.5 | 12.5 | 9.4 |
| | Control 1 | 2 | 3 |
| Cariflex ® BR-1220 | 70 | | |
| Taktene ® 1220 | 30 | | |

-continued

| Materials | | | |
|---|---|---|---|
| BCP-820 | | 40 | 40 |
| Nes Cis 60 | | 30 | 30 |
| Nes Cis 40 | | 30 | 30 |
| ZnO | 24.9 | 23.2 | 23.7 |
| T.G. Regrind | 20 | | |
| Zn Stearate | 15 | 16 | 16 |
| Zinc Diacrylate (ZDA) | 18.3 | 21.7 | 20.7 |
| Color M.B. | .14 | | .14 |
| | Red | White | Lav. |
| 231 XL | 0.90 | 1.25 | 1.25 |
| | 179.24 | 162.15 | 161.79 |
| size pole | 1.560 | 1.557 | 1.557 |
| wgt. | 37.8 | 37.6 | 37.6 |
| Comp. | 114 | 109 | 114 |
| COR | .775 | .789 | .787 |

A summary of the properties of these balls is set forth below.

| Sample Nos. | 1<br>1(C) | 2<br>2 | 3<br>3 | 4<br>1(C) | 5<br>2 | 6<br>3 | 7<br>1(C) | 8<br>2 | 9<br>3 |
|---|---|---|---|---|---|---|---|---|---|
| Core Data | | | | | | | | | |
| Size | 1.56 | 1.557 | 1.557 | 1.56 | 1.557 | 1.557 | 1.56 | 1.557 | 1.557 |
| Weight | 37.8 | 37.6 | 37.6 | 37.8 | 37.6 | 36.6 | 37.8 | 37.6 | 37.6 |
| Comp | 114 | 109 | 114 | 114 | 109 | 114 | 114 | 109 | 114 |
| COR | 775 | 789 | 787 | 775 | 789 | 787 | 775 | 789 | 787 |

-continued

| Sample Nos. | 1 1(C) | 2 2 | 3 3 | 4 1(C) | 5 2 | 6 3 | 7 1(C) | 8 2 | 9 3 |
|---|---|---|---|---|---|---|---|---|---|
| Cover Type | | | | | | | | | |
| Magna EX (C) | | | | | | | X | X | X |
| 1006/1007 (B) | | | | | X | X | X | | |
| 8140/6120 (A) | X | X | X | | | | | | |
| Ball Data | | | | | | | | | |
| PGA ® Comp. | 69 | 74 | 70 | 65 | 70 | 65 | 63 | 66 | 63 |
| Riehle ® Comp | 91 | 86 | 90 | 95 | 90 | 95 | 97 | 94 | 97 |
| COR | 810 | 820 | 818 | 803 | 813 | 812 | 796 | 806 | 804 |
| Shore ® D | 70 | 70 | 70 | 67 | 67 | 67 | 64 | 64 | 64 |
| Barrel (Avg) | | 503 | | | 615 | | | 660 | |
| Durability | | | | | | | | | |
| Min | | 302 | | | 456 | | | 433 | |
| Max | | 696 | | | 818 | | | 852 | |
| NES Factor | 901 | 906 | 908 | 898 | 903 | 907 | 893 | 900 | 901 |

EXAMPLE 4

An additional embodiment according to the present invention utilizes blends of the Neo Cis polymers in the core compositions. The following Table represents preferred core formulations which utilizes a blend of Neo Cis 40 and Neo Cis 60 with Cariflex® BCP-820 (amounts of ingredients are in parts per hundred rubber (phr) based on 100 parts butadiene rubber):

| | Formulation No. | | | |
|---|---|---|---|---|
| Ingredient | 1 | 2 | 3 | 4 |
| Cariflex ® BCP-820 | 40 | 40 | 40 | 40 |
| Neo Cis 60 | 30 | 30 | 30 | 30 |
| Neo Cis 40 | 30 | 30 | 30 | 30 |
| Zinc Oxide | 31.4 | 30.9 | 26 | 24.6 |
| Zinc Stearate | 16 | 16 | 16 | 16 |
| ZDA | 18.2 | 19.2 | 18.2 | 19.6 |
| Yellow MB | 0.14 | — | — | — |
| Green MB | 0.05 | — | — | — |
| Black MB | — | 0.2 | — | — |
| Red MB | — | — | 0.075 | 0.075 |
| Blue MB | — | — | 0.075 | 0.075 |
| Triganox 42-40B | 1.25 | 1.25 | 1.25 | 1.25 |

The core formulations set forth above were then utilized to produce the following corresponding small cores:

| | Core Sample | | | |
|---|---|---|---|---|
| Property | 1 | 2 | 3 | 4 |
| Size (pole dia. inches) | 1.47" ± 0.004 | 1.47" ± 0.004 | 1.47" ± 0.004 | 1.47" ± 0.004 |
| Weight (grams) | 33.3 g ± 0.3 | 33.3 g ± 0.3 | 31.5 ± 0.3 | 31.5 ± 0.3 |
| Riehle ® Comp. | 135 ± 10 | 125 ± 10 | 145 ± 8 | 135 ± 8 |
| C.O.R. | 0.775 ± 0.015 | 0.765 ± 0.015 | 0.760 ± 0.015 | 0.770 ± 0.015 |
| Specific Gravity | 1.194 ± 0.05 | 1.194 ± 0.05 | 1.168 | 1.168 |
| JIS C | 69 ± 2 | 71 ± 2 | 70 ± 2 | 71 ± 2 |
| Shore ® C | 69 ± 2 | 71 ± 2 | 70 ± 2 | 71 ± 2 |
| Shore ® D | 40 ± 2 | 42 ± 2 | 41 ± 2 | 42 ± 2 |

In an additional experiment, the small cores utilizing the blend of Neo Cis 40 and Neo Cis 60 have a mantle or inner cover layer formed thereon. A variety of ionomers may be utilized in the mantle or inner cover layer of the multi-layer golf balls. Ionomeric resins such as those designated as Surlyn®, manufactured by DuPont, and lotek®, manufactured by Exxon, are suitable for forming the mantle layer, but any polymer conventionally used to form inner cover layers in the multi-layer golf balls can be used. The following Table includes ionomers which are exemplary of specific ionomers which may be utilized in the inner cover layer of multi-layer balls.

| | Individual Ionomers | | |
|---|---|---|---|
| | Iotek ® 1002 | Iotek ® 1003 | Surlyn ® 8552 |
| % Acid Type | 18% AA | 18% AA | 19% MA |
| Ionomer Type | Copolymer | Copolymer | Copolymer |
| Cation | Na | Zn | Mg |
| Melt Index | 2 | 1 | 1.3 |
| Stiffness Modulus *2 | 4053 MPa | 1873 MPa | 3499 Kfg/cm$^2$ |

AA = Acrylic Acid; MA = Methacrylic Acid
*2 Stiffness measurements done using Toyoseiki Stiffness Tester The mantle layer may also contain other additives such as heavy weight fillers including bronze, brass, tungsten, and the like.

The following represents various intermediate golf balls formed from the above cores.

| Intermediate Ball with Inner Cover | 1 | 2 | 3 | 4 |
|---|---|---|---|---|
| Core Formulation (From Table 31) | 1 | 2 | 3 | 4 |
| Mantle Composition (Wt %) | | | | |
| Iotek ® 1002 (Na) | 50% | 50% | 35% | 35% |
| Iotek ® 1003 (Zn) | 50% | 50% | — | — |
| Surlyn ® 8552 (Ma) | — | — | 65% | 65% |
| Filler (Bronze Powder) | — | — | 19.0 pph | 19.0 pph |
| $TiO_2$ | — | — | 0.1 pph | 0.1 pph |

The inner cover layers, or mantles, as set forth in the Table above have the following characteristics as shown in the Table below:

| | Intermediate Ball | | | |
|---|---|---|---|---|
| Property | 1 | 2 | 3 | 4 |
| Flex Modulus (weighted avg.) | 264 MPa | 264 MPa | 264 MPa | 264 MPa |
| Stiffness Modulus | 3521 Kgf/cm$^2$ | 3521 Kgf/cm$^2$ | 3521 Kgf/cm$^2$ | 3521 Kgf/cm$^2$ |
| Size (intermediate ball) | 1.570" ± 0.004 | 1.570" ± 0.004 | 1.570" ± 0.004 | 1.570" ± 0.004 |
| Weight (intermediate ball) | 38.3 g ± 0.3 | 38.3 g ± 0.3 | 38.3 g ± 0.3 | 38.3 g ± 0.3 |
| Thickness | 0.050" ± 0.008 | 0.050" ± 0.008 | 0.050" ± 0.008 | 0.050" ± 0.008 |
| Riehle ® Comp | 122 ± 12 | 112 ± 12 | 112 ± 12 | 106 ± 8 |
| C.O.R. | 0.780 ± 0.015 | 0.790 ± 0.015 | 0.790 ± 0.015 | 0.795 ± 0.015 |
| Mantle Specific Gravity | 0.96 ± 0.01 | 0.96 ± 0.01 | 1.12 ± 0.05 | 1.12 ± 0.05 |
| JIS C | 97 ± 1 | 97 ± 1 | 97 ± 1 | 97 ± 1 |
| Shore ® C | 97 ± 1 | 97 ± 1 | 97 ± 1 | 97 ± 1 |
| Shore ® D | 70 ± 1 | 70 ± 1 | 70 ± 1 | 70 ± 1 |

The intermediate balls were then formed into finished golf balls by covering them with an outer cover formulation. The covers are typically ionomeric but other polymers may be utilized in the covers as set forth herein before. Ionomers typically associated with the golf balls according to the present invention include those designated as Surlyn®, manufactured by DuPont, and lotek®, manufactured by Exxon. The ionomers may be used individually or in blends. The following Table includes ionomers which are exemplary of specific ionomers that may be utilized for the outer cover layer of the golf balls.

The intermediate golf balls above were then covered with cover formulations to produce the following finished golf balls:

| Finished Ball | A | B | C | D |
|---|---|---|---|---|
| Intermediate Ball | 1 | 2 | 3 | 4 |
| Cover Composition (Wt %) | | | | |
| Surlyn ® 8549 (Na) | 7.3% | 7.3% | — | — |
| Iotek ® 7510 (Zn) | 42% | 42% | — | 58.9% |
| Iotek ® 7520 (Zn) | 50.7% | 50.7% | — | — |
| Surlyn ® 8940 (Na) | — | — | 17% | — |
| Surlyn ® 9910 (Zn) | — | — | 50.1% | — |
| Surlyn ® 8320 (Na) | — | — | 17.9% | — |
| Surlyn ® 8120 (Na) | — | — | 7.7% | — |

-continued

| Finished Ball | A | B | C | D |
|---|---|---|---|---|
| Intermediate Ball | 1 | 2 | 3 | 4 |
| Iotek ® 7030 (Zn) | — | — | 7.3% | 7.3% |
| Iotek ® 8000 (Na) | — | — | — | 33.8% |
| Whitener ($TiO_2$)* | 2.3 phr | 2.3 phr | 2.3 phr | 2.3 phr |

*Amount based on parts per hundred resin

| Outer Cover Ionomers | | | | | |
|---|---|---|---|---|---|
| | Surlyn ® 8940 | Surlyn ® 9910 | Surlyn ® 8320 | Surlyn ® 8120 | Surlyn ® 8549 |
| % Acid Type | 15% MA | 15% MA | ~7% MA | ~7% MA | 15% MA |
| Ionomer Type | Copolymer | Copolymer | Terpolymer | Terpolymer | Copolymer |
| Cation | Na | Zn | Na | Na | Na |
| Melt Index | 2.8 | 0.7 | 0.8 | 2 | 2.3 |
| Siffness Modulus*2 | 2705 Kgf/cm$^2$ | 2874 Kgf/cm$^2$ | 168 Kgf/cm$^2$ | 492 Kgf/cm$^2$ | — |
| | | Iotek ® 7030 | Iotek ® 7510 | Iotek ® 7520 | Iotek ® 8000 |
| % Acid Type | | 15% AA | 6% AA | 6% AA | 15% AA |
| Ionomer Type | | Copolymer | Terpolymer | Terpolymer | Copolymer |
| Cation | | Zn | Zn | Zn | Na |
| Melt Index | | 2.5 | 0.8 | 2 | 2 |
| Stiffness Modulus*2 | | 1840 Kgf/cm$^2$ | 284 Kgf/cm$^2$ | 270 MPa | 3323 Kgf/cm$^2$ |

AA = Acrylic Acid; MA = Methacrylic Acid

*2 Stiffness measurements done using Toyoseiki Stiffness Tester

The finished balls above had the following characteristics:

| Property | Finished Ball A | B | C | D |
|---|---|---|---|---|
| Flex Modulus (weighted avg.) | 58 MPa | 58 MPa | 240 Mpa | 140 MPa |
| Stiffness Modulus (estimate) | ~300 Kgf/cm$^2$ | ~300 Kgf/cm$^2$ | 1820 Kgf/cm$^2$ | 763 Kgf/cm$^2$ |
| Combined Mantle/Cover Stiffness | ~700 Kgf/cm$^2$ | ~700 Kgf/cm$^2$ | 1942 Kgf/cm$^2$ | — |
| Cover Specific Gravity | 0.98 ± 0.01 | 0.98 ± 0.01 | 0.98 ± 0.01 | 0.98 ± 0.01 |
| Size | 1.685" ± 0.005 | 1.685" ± 0.005 | 1.685" ± 0.005 | 1.685" ± 0.005 |
| Weight | 45.4 g ± 0.4 | 45.4 g ± 0.4 | 45.4 g ± 0.4 | 45.4 g ± 0.4 |
| Riehle ® Compression | 105 ± 10 | 100 ± 10 | 95 ± 5 | 85 ± 5 |
| C.O.R. | 0.770 ± 0.015 | 0.780 ± 0.015 | 0.790 ± 0.015 | 0.790 ± 0.015 |
| JIS C | 72 ± 1 | 72 ± 1 | 93 ± 1 | 87 ± 1 |
| Shore ® C | 72 ± 1 | 72 ± 1 | 93 ± 1 | 87 ± 1 |
| Shore ® D | 46 ± 1 | 46 ± 1 | 62 ± 1 | 56 ± 1 |

An additional step of exposure to gamma radiation was performed on balls A and B producing golf balls having the following characteristics:

| Finished Ball | Finished Balls (Post Gamma) A (Ball) | A (Core) | B (Ball) | B (Core) |
|---|---|---|---|---|
| Property (Post Gamma) | | | | |
| Gamma Dosage (Ball) | 35–70 Kgys | — | 35–70 Kgys | — |
| Size | 1.683" ± 0.003 | 1.47" ± 0.004 | 1.683" ± 0.003 | 1.47 ± 0.004 |
| Thickness (Cover) | 0.057" ± 0.008 | — | 0.057" ± 0.008 | — |
| Weight | 45.5 g ± 0.4 | 33.3 g ± 0.3 | 45.5 g ± 0.4 | 33.3 g ± 0.3 |
| Riehle ® Compression | 86 ± 5 | 120 ± 10 | 81 ± 5 | 110 ± 10 |
| C.O.R. | 0.795 ± 0.015 | 0.770 ± 0.020 | 0.800 ± 0.015 | 0.780 ± 0.020 |
| Cover Specific Gravity | 0.98 ± 0.01 | — | 0.98 ± 0.1 | — |
| Core Specific Gravity | — | 1.194 ± 0.05 | — | 1.194 ± 0.05 |
| JIS C | 72 ± 1 | 78 ± 2 | 72 ± 1 | 80 ± 2 |
| Shore ® C | 72 ± 1 | 78 ± 2 | 72 ± 1 | 80 ± 2 |
| Shore ® D | 46 ± 1 | 48 ± 2 | 46 ± 1 | 50 ± 2 |
| Dimple Pattern | 422 Tri | — | 422 Tri | — |

The method of gamma radiation treatment of golf balls, including benefits and property changes attained therefrom, is taught in commonly assigned U.S. Pat. No. 5,857,925 to Sullivan et al., which is incorporated herein by reference. Benefits and/or property changes associated with gamma radiation treatment of golf balls include, but are not limited to, increased melting temperature for the ionomer cover, increased compression and C.O.R. for the core, allows softer starting materials for core, etc.

EXAMPLE 5

In yet another experiment, golf balls having a core and a cover were formed according to the compositions provided below. The golf balls designated 1–4 below utilize polybutadiene rubbers which are not considered to be ultra high Mooney viscosity rubbers.

| Materials | Cores 1 | 2 | 3 | 4 | 5 | 6 | 7 |
|---|---|---|---|---|---|---|---|
| Cariflex ® 1220 | 70 | 70 | 70 | 70 | — | — | — |
| Taktene ® 220 | 30 | 30 | 30 | 30 | — | — | — |

-continued

| Materials | Cores 1 | 2 | 3 | 4 | 5 | 6 | 7 |
|---|---|---|---|---|---|---|---|
| BCP 820 (1220X) | — | — | — | — | 40 | 40 | 40 |
| Neo Cis 60 | — | — | — | — | 30 | 30 | 30 |
| Neo Cis 40 | — | — | — | — | 30 | 30 | 30 |
| Regrind | 10 | 20.5 | 20.5 | 17 | 0.2 | — | — |
| Zinc Oxide | 24.33 | 23 | 22.8 | 9.5 | 22.10 | 24 | 24 |
| Tungsten Powder | 0.17 | 0.17 | 0.17 | 0.17 | — | 0.17 | 0.17 |
| Zinc Stearate | 20 | 20 | 20 | 15 | 16.0 | 16.3 | 16.3 |
| ZDA | 22 | 22 | 23.2 | 19 | 24.30 | 20.5 | 20.5 |
| Red MB | — | — | — | — | 0.08 | 0.14 | 0.14 |
| Blue MB | — | — | — | — | 0.08 | — | — |
| Yellow MB | 0.14 | — | — | — | — | — | — |
| Black MB | — | 0.14 | 0.14 | — | — | — | — |
| Orange MB | — | — | — | 3.5 | — | — | — |
| PolyPro 20 Mesh | — | — | — | 0.15 | — | — | — |
| 231 XL or 29/40 | 0.9 | 0.9 | 0.9 | 0.9 | — | — | — |
| Trig 42-40B | — | — | — | — | 1.25 | 1.24 | 1.24 |

*amounts in parts per hundred resin

Golf ball cores having the following properties were produced from the core formulations.

| Properties | Core 1 | 2 | 3 | 4 | 5 | 6 | 7 |
|---|---|---|---|---|---|---|---|
| Size | 1.543" ± 0.008 | 1.543" ± 0.008 | 1.543" ± 0.008 | 1.570" ± 0.008 | 1.540" | 1.56" ± 0.005 | 1.56" ± 0.005 |
| Weight | 36.7 g ± 0.4 | 36.7 g ± 0.4 | 36.7 g ± 0.4 | 35.4 g ± 0.4 | 36.43 g | 38.0 g ± 0.004 | 38.0 g ± 0.004 |
| Riehle ® Comp. | 96 ± 8 | 105 ± 8 | 92 ± 8 | 115 ± 10 | 97 | 113 ± 9 | 113 ± 9 |
| C.O.R. | 0.795 ± 0.015 | 0.780 ± 0.015 | 0.780 ± 0.015 | 0.773 ± 0.015 | — | 0.780 ± 0.010 | 0.780 ± 0.010 |
| Specific Gravity | 1.168 ± 0.005 | 1.168 | 1.168 | 1.078 ± 0.004 | — | 1.16 | 1.16 |
| JIS C | 79 ± 2 | 77 ± 2 | 80 ± 2 | 77 ± 1 | — | 73 ± 1 | 73 ± 2 |
| Shore ® C | 79 ± 2 | 77 ± 2 | 81 ± 2 | 79 ± 1 | — | 75 ± 2 | 75 ± 2 |
| Shore ® D | 49 ± 2 | 48 ± 2 | 50 ± 2 | 45 ± 1 | — | 44 ± 1 | 44 ± 1 |

The above cores were then formed into finished golf balls by covering them with an outer cover formulation.

| Outer Cover Ionomers | Surlyn ® 8940 | Surlyn ® 9910 | Surlyn ® 8320 | Surlyn ® 8120 | Surlyn ® 8549 | Surlyn ® 8552/6120 | Surlyn ® 8140 |
|---|---|---|---|---|---|---|---|
| % Acid Type | 15% MA | 15% MA | ~7% MA | ~7% MA | 15% MA | 19% MA | 19% MA |
| Ionomer Type | Copolymer | Copolymer | Terpolymer | Terpolymer | Copolymer | Copolymer | Copolymer |
| Cation | Na | Zn | Na | Na | Na | Na | Mg |
| Melt Index | 2.8 | 0.7 | 0.8 | 2 | 2.3 | 2.6 | 1.3 |
| Stiffness Modulus*2 | 2705 Kgf/cm$^2$ | 2874 Kgf/cm$^2$ | 168 Kgf/cm$^2$ | 492 Kgf/cm$^2$ | — | — | 3499 Kgf/cm$^2$ |

| | Iotek ® 7030 | Iotek ® 7510 | Iotek ® 7520 | Iotek ® 8000 | Iotek ® 1006 | Iotek ® 1007 |
|---|---|---|---|---|---|---|
| % Acid Type | 15% AA | 6% AA | 6% AA | 15% AA | 15% AA | 15% AA |
| Ionomer Type | Copolymer | Terpolymer | Terpolymer | Copolymer | Copolymer | Copolymer |
| Cation | Zn | Zn | Zn | Na | Na | Zn |
| Melt Index | 2.5 | 0.8 | 2 | 2 | 1.3 | 0.9 |
| Stiffness Modulus*2 | 1840 Kgf/cm$^2$ | 284 Kgf/cm$^2$ | 270 MPa | 3323 Kgf/cm$^2$ | 2719 Kgf/cm$^2$ | 1498 Kgf/cm$^2$ |

AA = Acrylic Acid; MA = Methacrylic Acid
*2 Stiffness measurements done using Toyoseiki Stiffness Tester Finished golf balls were prepared utilizing the cores from above, and cover materials from above. The finished golf balls are set forth below.

| | Finished Ball A | B | C | D | E | F | G | H |
|---|---|---|---|---|---|---|---|---|
| Core | 1 | 2 | 3 | 4 | 5 | 6 | 7 | 6 |
| Cover Material(s) (Wt %) | | | | | | | | |
| Surlyn ® 8940 (Na) | 10.3 | — | — | — | 10.3 | — | 22.0 | — |
| Surlyn ® 9910 (Zn) | 26.8 | — | — | — | 26.8 | — | 54.4 | — |
| Surlyn ® 8320 (Na) | 38.2 | — | — | — | 38.2 | — | 10 | — |
| Surlyn ® 8120 (Na) | 15.0 | — | — | — | 15.0 | — | 1.00 | — |
| Surlyn ® 8549 | — | — | — | — | — | — | — | — |
| Iotek ® 7030 (Zn) | 9.7 | 9.7 | 9.7 | 9.7 | 9.7 | 9.7 | 9.7 | 9.7 |
| Iotek ® 7510 | — | — | — | — | — | — | — | — |
| Iotek ® 7520 | — | — | — | — | — | — | — | — |
| Iotek ® 8000 | — | — | — | — | — | — | — | — |
| Surlyn ® 8552/6120 (Mg) | — | 54.2 | 54.2 | — | — | 45.15 | — | 40.7 |
| Surlyn ® 8140 (Na) | — | 36.1 | 36.1 | — | — | — | — | — |
| Iotek ® 1006 | — | — | — | 36.1 | — | 45.15 | — | 46.8 |
| Iotek ® 1007 | — | — | — | 54.2 | — | — | — | — |
| Whitener ($TiO_2$)* | 3.1 phr | 3.1 phr | 3.1 phr | 3.1 phr | 3.1 phr | 3.1 phr | 3.1 phr | 3.1 phr |

*Parts per hundred resin

The finished golf balls above were found to have the following properties:

| Properties | Finished Golf Balls A | B | C | D | F | G |
|---|---|---|---|---|---|---|
| Flex Modulus (weighted avg.) | 154 MPa | 472 MPa | 472 MPa | 201 MPa | 379 MPa | 276 MPa |
| Stiffness Modulus | <1820 Kgf/cm$^2$ | — | — | — | — | — |
| Specific Gravity (Cover) | 0.98 ± 0.01 | 0.98 ± 0.01 | 0.98 ± 0.01 | 0.99 ± 0.01 | 0.98 ± 0.01 | 0.98 ± 0.01 |
| Size | 1.685" ± 0.005 | 1.685" ± 0.005 | 1.685" ± 0.005 | 1.715" ± 0.005 | 1.685" ± 0.005 | 1.685" ± 0.005 |
| Weight | 45.4 g ± 0.4 | 45.4 g ± 0.4 | 45.4 g ± 0.4 | 45.4 g ± 0.4 | 45.4 g ± 0.4 | 45.4 g ± 0.4 |
| Riehle ® Comp. | 90 ± 5 | 75 ± 5 | 70 ± 5 | 90 ± 5 | 95 ± 5 | 97 ± 3 |
| C.O.R. | 0.790 ± 0.015 | 0.810 ± 0.010 | 0.810 ± 0.010 | 0.805 ± 0.012 | 0.806 ± 0.009 | 0.803 ± 0.005 |
| JIS C | 85 ± 1 | 99 ± 1 | 99 ± 1 | 95 ± 1 | 95 ± 1 | 91 ± 1 |
| Shore ® C | 87 ± 1 | 99 ± 1 | 99 ± 1 | 97 ± 1 | 97 ± 1 | 93 ± 1 |
| Shore ® D | 59 ± 1 | 73 ± 1 | 73 ± 1 | 68 ± 1 | 69 ± 1 | 65 ± 1 |

EXAMPLE 6

The Preferred Golf Balls of the Present Invention

A. Relatively soft, high resilience, solid polybutadiene cores (non-glebarred, 1.56" diameter high molecular weight) were produced using the below materials to produce the properties indicated:

| Core Formulation | Actual PHR | Specific Gravity | | |
|---|---|---|---|---|
| Material | | | | |
| High Molecular Weight Polybutadiene Rubber [HMWPBD] (high cis) | 40.00 ± 2 | 0.910 | | |
| PBD High Cis 60 Mooney | 30.00 ± 2 | 0.910 | | |
| PBD High Cis 40 Mooney | 30.00 ± 2 | 0.910 | | |
| Zinc Oxide | 23.60 ± 2 | 5.570 | | |
| Zn Sterate | 16.00 ± 2 | 1.090 | | |
| Zinc Diacrylate | 22.00 ± 2 | 2.100 | | |
| Peroxide | 1.25 ± 2 | 1.400 | | |
| Totals | 162.85 ± 2 | 1.162 | | |
| Properties | | | | |
| Target Riehle ® Compression = | 108 Riehle ®** ± 5 | | | |
| Target PGA ® Compression = | 52 PGA ® ± 5 | | | |
| Compound S.C. = | 1.1618 | Target S.G. = | 1.1620 | |
| | | Target Size = | 1.558" ± 0.005 | |
| | | Target Weight = | 37.3 gr. ± 50.4 g | |
| | | Target COR = | 0.789 ± 0.010 | |

**pre-gamma compression
JIS-C at core surface = 82
JIS-C at core center = 71

The cores were then covered with an ionomer blend consisting of lotek® 8000/lotek® 7510/7030 masterbatch at the ratio of 22±2%:68.5±2%: 9.5±2% and molded (422 tri dimple pattern) to produce balls (post-gamma) having the following properties:

| | Size | Weight | Riehle ® Comp. | PGA ® Comp. | C.O.R. |
|---|---|---|---|---|---|
| Core Color | | | | | |
| white (or natural) target ranges: | 1.558 ±0.005 | 37.3 ±0.4 g | 108 ±5 | 52 ±5 | 0.789 ±0.010 |
| Molded (pre-gamma) | no data was taken on pre-gamma balls | | | | |
| Finished (post-gamma) | | | | | |
| Paint Description | | | | | |
| Fast Cure SRC target ranges | 1.6825 ±0.0025 | 45.50 ±0.35 | 87 ±5 | 73 ±5 | 0.803 ±0.010 |

B. Additional soft cores were produced according to the following formulations:

| Core Formulations | Option 1 Core | | Option 2 Core | |
|---|---|---|---|---|
| Materials | Parts | Wt % | Parts | Wt % |
| BCP 820 | 40 | 0.2453235 | 40 | 0.245 |
| Neo Cis 40 | 30 | 0.1839926 | 30 | 0.184 |
| Neo Cis 60 | 30 | 0.1839926 | 30 | 0.184 |
| Zinc Oxide | 23.3 | 0.142901 | 22.8 | 0.140 |
| ZDA | 22.5 | 0.1379945 | 23.3 | 0.143 |
| Zinc Sterate | 16 | 0.0981294 | 16 | 0.098 |
| Trig 42-40 B | 1.25 | 0.0076664 | 1.25 | 0.008 |
| Total | 163.05 | 100 | 163.35 | 100 |

These cores produced the following properties and were then covered by the composition set forth below to produce the following finished ball properties:

| | | Option 1 Core | | Option 2 Core | |
|---|---|---|---|---|---|
| | | (pre-gamma) | (post-gamma) | (pre-gamma) | (post-gamma) |
| CORE | Size | 1.560" ± 0.005 | 1.560" ± 0.005 | 1.560" ± 0.005 | 1.560" ± 0.005 |
| | Weight | 37.5 ± 0.04 | 37.5 ± 0.04 | 37.5 ± 0.04 | 37.5 ± 0.04 |
| | Riehle ® Comp | 105 ± 7 | 85 ± 7 | 100 ± 7 | 83 ± 7 |
| | C.O.R. | 0.788 ± 0.008 | 0.805 ± 0.008 | 0.790 ± 0.008 | 0.807 ± 0.008 |
| | S.G. | 1.162 | 1.162 | 1.162 | 1.162 |
| | JIS C | 77 ± 2 | 84 ± 2 | 79 ± 2 | 85 ± 2 |
| | Shore ® C | 79 ± 2 | 85 ± 2 | 80 ± 2 | 86 ± 2 |
| | Shore ® D | 46 ± 2 | 52 ± 2 | 59 ± 2 | 55 ± 2 |
| MOLDED | Cover Composition | Wt % | Wt % | Wt % | Wt % |
| | Iotek ® 7510 | 70 | 70 | 42 | 42 |
| | Iotek ® 7520 | — | — | 50.7 | 50.7 |
| | Iotek ® 8000 | 22.4 | 22.4 | — | — |
| | Surlyn 8549 | 7.3 | 7.3 | 7.3 | 7.3 |
| | Whitener Package | 2.3 | 2.3 | 2.3 | 2.3 |
| | Stiffness Modulus (est.) | <700 Kgf/cm$^2$ | NA | ~300 Kgf/cm$^2$ | NA |
| | Flex Modulus (estimate) | <130 MPa | NA | 50 MPa | NA |
| | Size | 1.685" ± 0.005 | 1.685" ± 0.005 | 1.685" ± 0.005 | 1.685" ± 0.005 |
| | Cover Thickness | 0.063 ± 0.005 | 0.063 ± 0.005 | 0.063 ± 0.005 | 0.063 ± 0.005 |
| | Weight (g) | 45.5 ± 0.4 | 45.5 ± 0.4 | 45.5 ± 0.4 | 45.5 ± 0.4 |
| | Riehle ® Comp | 100 ± 7 | 86 ± 8 | 100 ± 7 | 86 ± 8 |
| | COR | 0.792 ± 0.008 | 0.803 ± 0.008 | 0.790 ± 0.008 | 0.803 ± 0.008 |
| | Cover SG | 0.98 | 0.98 | 0.98 | 0.98 |
| | Dimple | 422 tri | 422 tri | 422 tri | 422 tri |
| | Dosage | — | 30 to 50 Kgys | — | 30 to 50 Kgys |
| | JIS C | 75 ± 2 | 75 ± 2 | 68 ± 2 | 68 ± 2 |
| | Shore ® C | 77 ± 2 | 77 ± 2 | 70 ± 2 | 70 ± 2 |
| | Shore ® D | 52 ± 2 | 52 ± 2 | 45 ± 2 | 45 ± 2 |
| FINISHED | Size | NA | 1.685" ± 0.005 | NA | 1.685" ± 0.005 |
| | Cover Thickness | NA | 0.063" ± 0.005 | NA | 0.063" ± 0.005 |
| | Weight | NA | 45 ± 0.4 | NA | 45 ± 0.4 |
| | Comp | NA | 87 ± 7 | NA | 87 ± 7 |
| | COR | NA | 0.805 ± 0.008 | NA | 0.805 ± 0.008 |
| | JIS C | NA | 75 ± 2 | NA | 68 ± 2 |
| | Shore ® C | NA | 77 ± 2 | NA | 70 ± 2 |
| | Shore ® D | NA | 52 ± 2 | NA | 45 ± 2 |

The balls of Section A above and Option 1 of Section B are representative of the most preferred balls of the present invention. These balls were designated "Ultimate Spin" and were tested against other commercial balls to produce the following results:

| | Ball Properties | | | | Spin | | | | Distance |
|---|---|---|---|---|---|---|---|---|---|
| Product | PGA ® Comp.** | COR | Cover Hardness | M.O.I. | Pro Driver | 5 Iron | 9 Iron | Chip | Pro. Dr. |
| Ultimate Spin | 73 | .803 | 53D<br>77.4 Shore ® C | 0.43913 | *3369 | *6941 | *10686 | 4341 | 287 |
| Strata ML Balata 90 | 71 | .795 | 57D | 0.44416 | (2738) | (5846) | (8473) | 3947 | (289) |
| Strata TP 90 | 75 | .787 | 47D | 0.43770 | *2918 | *6084 | *9362 | 4243 | 288 |
| Titleist Tour Balata 90 | 74 | .793 | 47D | 0.40358 | *3948 | *7180 | *10714 | 4249 | 278 |
| Titleist Tour Prestige 90 | 80 | .786 | 55D | 0.41129 | *3538 | *6640 | *10036 | 3939 | 284 |
| Precept MC Spin | 81 | .796 | 55D | 0.44228 | *2875 | *6005 | *9559 | 4122 | 289 |
| Titleist HP Tour | 68 | .799 | 60D | 0.44237 | *2805 | *5873 | *9313 | 3798 | (289) |

Notes:
( ) = estimated from other tests
*= spin results from WPB; all other spin results are from Chicopee
**converted from Riehle ® Compression - (160-Riehle ® = PGA ®)

The performance characteristics, in summary, show this product to be the highest spinning two-piece golf ball in the group, with spin rates in the range of the highest spinning three-piece wound ball (the Titleist® Tour Balata). Despite the very high spin rate, distance results met or exceeded expectations, with the pro driver distance being comparable or longer than the competitive set listed. The 5 iron distance results are comparable to the competitive wound balls listed (Titleist® Tour Balata and Tour Prestige).

Figure 3:
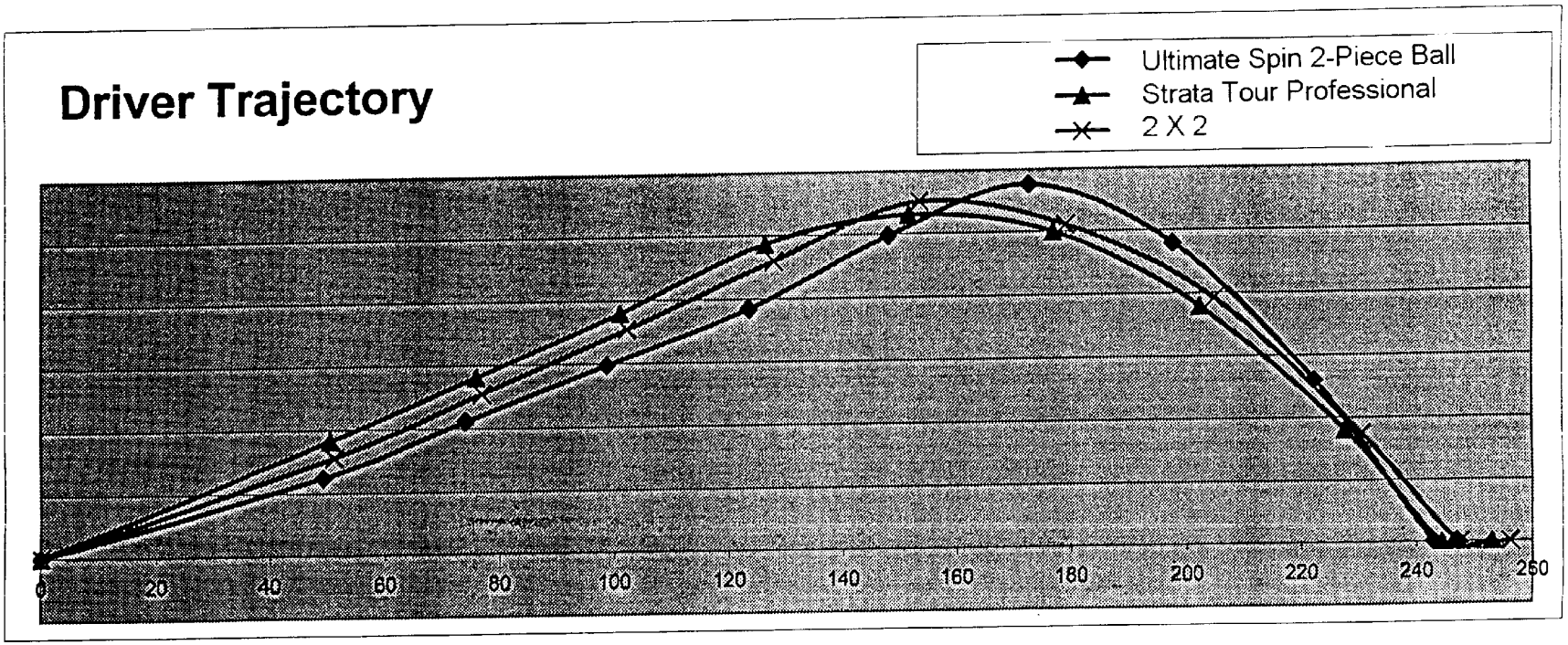
FIG. 3 is a diagram illustrating the driver trajectory of a ball produced according to the present invention.

From machine and limited player testing, the ball flight/trajectory approaches that of a Titleist® Tour Balata wound ball and can be described as being a "rising" trajectory versus a "boring" or "penetrating" trajectory. See FIG. 3.

The invention has been described with reference to the preferred embodiments. Obviously, modifications and alterations will occur to others upon reading and understanding the preceding detailed description. It is intended that the invention be construed as including all such alternations and modifications insofar as they come within the scope of the claims and the equivalents thereof.

Having thus described the preferred embodiments, the invention is now claimed to be:

1. A golf ball comprising:

a solid core having a PGA compression of 80 or less, the core including (i) a first polybutadiene rubber obtained utilizing a cobalt catalyst and having a Mooney viscosity in the range of from about 70 to about 83, and (ii) a blend of polybutadiene rubbers wherein each is obtained by utilizing a neodymium series catalyst and having a Mooney viscosity of from about 30 to about 70; and a cover disposed about said core, the cover having a Shore D hardness of 55 or less;

wherein said ball has a PGA compression of 80 or less and a coefficient of restitution of at least 0.800.

2. The golf ball of claim 1 wherein said first polybutadiene rubber includes at least 90% cis-1,4 polybutadiene.

3. The golf ball of claim 1 wherein said core composition comprises one or more high molecular weight polybutadienes.

4. The golf ball of claim 1 wherein said cover has a thickness of 0.063±0.005 inches.

5. The golf ball of claim 1 wherein said ball has a PGA compression of 70 or less.

6. The golf ball of claim 1 wherein said blend of polybutadiene rubbers comprises a first polybutadiene having a Mooney viscosity of about 40 and a second polybutadiene having a Mooney viscosity of about 60.

7. The golf ball of claim 1 wherein said first polybutadiene rubber is present in an amount of about 40% by weight of the rubber composition of the core.

8. The golf ball of claim 1 wherein said ball has a coefficient of restitution of 0.805±0.005.

9. The golf ball of claim 1 wherein said blend of polybutadiene rubbers is comprised of about 30% by weight of a first polybutadiene having a Mooney viscosity of about 40 and about 30% by weight of a second polybutadiene having a Mooney viscosity of about 60.

10. The golf ball of claim 1 wherein the ball has a Shore D cover hardness of 53 or less.

11. The golf ball of claim 1 wherein the ball is further treated with gamma radiation.

12. The golf ball of claim 1 wherein the cover is comprised of an ionomer resin or a blend of ionomer resins.

13. The golf ball of claim 1 wherein the PGA compression of the ball is less than the PGA compression of the core.

14. The golf ball of claim 1 wherein said core further comprises a heavy weight filler.

15. The golf ball of claim 14 wherein the heavy weight filler is selected from tungsten, brass and bronze powder.

16. A two-piece golf ball comprising:

a solid core having a diameter of 1.552 inches or more, a PGA compression of 80 or less, and a coefficient of restitution of 0.800 or more; and, a cover layer having a Shore D hardness measured on the ball of 55 or less;

the ball having a PGA compression of 80 or less and a coefficient of restitution of 0.800 or more.

17. The golf ball of claim 16, wherein the ball is treated with gamma radiation to increase the coefficient of restitution of the ball.

18. The golf ball of claim 16, wherein the PGA compression of the ball is the same or lower than the PGA compression of the core.

19. A two-piece, high spinning golf ball comprising a solid core having a diameter of 1.560±0.005 inches, a PGA compression of 80 or less and a coefficient of restitution of 0.805±0.008; wherein said core comprises one or more high molecular weight polybutadienes; and a cover layer having a thickness of 0.063"±0.005 and a Shore D hardness of 53±2, wherein said cover comprises one or more ionomeric resins, wherein the ball has a PGA compression of 80 or less and a coefficient of restitution of 0.805±0.008.

20. The golf ball of claim 19, wherein the ball has a 422 tri dimple pattern.

* * * * *